US010220649B2

(12) United States Patent
Boettcher et al.

(10) Patent No.: US 10,220,649 B2
(45) Date of Patent: Mar. 5, 2019

(54) MOUNTING ACCESSORIES FOR WRITING IMPLEMENTS

(71) Applicant: Amazing Magnets, LLC, Anaheim, CA (US)

(72) Inventors: Timothy Paul Boettcher, Orange, CA (US); Luke T. Bilisoly, Fullerton, CA (US)

(73) Assignee: Amazing Magnets, LLC, Anaheim, CA (US)

( * ) Notice: Subject to any disclaimer, the term of this patent is extended or adjusted under 35 U.S.C. 154(b) by 0 days.

(21) Appl. No.: 15/607,155

(22) Filed: May 26, 2017

(65) Prior Publication Data

US 2017/0259612 A1 Sep. 14, 2017

Related U.S. Application Data

(63) Continuation-in-part of application No. 14/611,029, filed on Jan. 30, 2015, now Pat. No. 9,662,926.
(Continued)

(51) Int. Cl.
*B43K 23/00* (2006.01)
*B43K 8/02* (2006.01)
(Continued)

(52) U.S. Cl.
CPC ..... *B43K 23/001* (2013.01); *B43K 8/02* (2013.01); *B43K 29/00* (2013.01); *B43L 1/008* (2013.01)

(58) Field of Classification Search
CPC ..... B43K 23/001; B43K 23/002; B43K 8/02; B43K 23/016; B43K 23/04; B43K 23/08;
(Continued)

(56) References Cited

U.S. PATENT DOCUMENTS 2,297,806 A 10/1942 Smith
2,385,859 A 10/1945 Jacobson
(Continued)

FOREIGN PATENT DOCUMENTS

CN 204095369 1/2015
KR 20-0321360 7/2003
(Continued)

OTHER PUBLICATIONS

"The StikkiWorks Co.—Magnetic Marker Rings", http://www.stikkiworks.com/prodring, printed from the internet Dec. 11, 2015.

*Primary Examiner* — David Walczak
(74) *Attorney, Agent, or Firm* — Knobbe Martens Olson & Bear, LLP

(57) ABSTRACT

An apparatus for connecting a writing implement to a glassboard, whiteboard or the like has a housing adapted to be connected to a writing implement. The housing has a side surface with an opening formed therein and a recess extending from the opening into the housing. A magnet is disposed in the recess and has a first pole at the opening. The magnet provides a magnetic field in a direction away from the side surface of the housing. The apparatus enables a side periphery of a writing implement coupled with the apparatus to magnetically couple with the glassboard, whiteboard or the like in a predetermined orientation regardless of the initial orientation of approach of the writing implement even in the presence of a similarly magnetically self-supporting writing implement or object.

21 Claims, 21 Drawing Sheets

Related U.S. Application Data

(60) Provisional application No. 61/934,655, filed on Jan. 31, 2014.

(51) Int. Cl.
*B43K 29/00* (2006.01)
*B43L 1/00* (2006.01)

(58) Field of Classification Search
CPC ..... B43K 23/10; B43K 23/12; B43K 29/00; B43K 29/04; B43K 29/20; B43L 1/008
See application file for complete search history.

(56) References Cited

U.S. PATENT DOCUMENTS

| | | | |
|---|---|---|---|
| 2,644,212 | A | 7/1953 | Markowitz |
| 2,964,812 | A | 12/1960 | Cook |
| 3,159,372 | A | 12/1964 | McIntosh |
| 3,387,341 | A | 6/1968 | Mates et al. |
| D441,021 | S | 4/2001 | Roush |
| 6,305,864 | B1 | 10/2001 | Nguyen |
| 6,718,708 | B2 | 4/2004 | Donoghue |
| D493,836 | S | 8/2004 | Cegelski et al. |
| 6,846,122 | B1 | 1/2005 | Liao |
| 7,527,447 | B2 | 5/2009 | Huang |
| 8,235,262 | B1 | 8/2012 | Sakdol |
| 9,409,437 | B2 | 8/2016 | Green et al. |
| 9,662,926 | B1 | 5/2017 | Boettcher et al. |
| 2006/0194028 | A1 | 8/2006 | Moore |
| 2007/0014624 | A1 | 1/2007 | Fogelson et al. |
| 2008/0166173 | A1 | 7/2008 | Gibbons |
| 2008/0240840 | A1 | 10/2008 | Huang |
| 2010/0219217 | A1 | 9/2010 | Andochick |
| 2011/0091860 | A1 | 4/2011 | Supera et al. |
| 2018/0056710 | A1 | 3/2018 | Boettcher et al. |

FOREIGN PATENT DOCUMENTS

| | | |
|---|---|---|
| KR | 10-0946430 | 3/2010 |
| KR | 10-2013-0137873 | 12/2013 |
| WO | WO 2018/039177 | 3/2018 |

MOUNTING ACCESSORIES FOR WRITING IMPLEMENTS

CROSS REFERENCE

This application is a continuation-in-part of U.S. application Ser. No. 14/611,029, filed Jan. 30, 2015, now U.S. Pat. No. 9,662,926, which claims the benefit of provisional U.S. Application No. 61/934,655, filed Jan. 31, 2014.

BACKGROUND OF THE INVENTION

Field of the Invention

This disclosure relates to a device configured to be coupled with or to be integrated into a marker pen or other writing implement, such that the marker pen or writing implement is adapted for mounting on a glassboard, whiteboard or the like to conveniently locate the marker pen thereon.

Description of the Related Art

Blackboards and whiteboards have been in use for a long time. These devices provide a convenient space for instructors or attendees at meetings to record their thoughts for a group using chalk and pens. Whiteboard, and more recently glassboards, have gained popularity as more convenient and cleaner to use than blackboards. One common problem with whiteboards is a lack of systematic way to keep track of markers pens used with them. A common technique for keeping markers pens with the board includes using a tray formed in or mounted to the frame of the whiteboard.

Glassboards, which are gaining in popularity form part of, or are mounted to a wall surface. A layer of glass is the structure upon which the user writes. These devices improve on whiteboards in being more durable, and being more aesthetically pleasing with a sleek, modern look. While glassboards can be equipped with a tray for marker pens and other accessories, such components are utilitarian and take away from the aesthetics of the installation.

Pens and markers have been combined with attachment devices to help secure them to structures. Most pens have a clip for securing the pen to paper or a shirt pocket. Lanyards can be attached to pen body or caps to make the pen wearable. Magnets have been used in place of clips or to secure ends of a pen to an object. While these techniques have been used even in connection with whiteboards, the magnet arrangements have been insufficient or inconvenient for use with glassboards, whiteboards, and the like.

SUMMARY OF THE INVENTION

In one embodiment, an adaptor is provided for securing a writing implement to a glassboard, a whiteboard, or the like. The adaptor includes a magnet housing, a magnet, and a coupler. The magnet housing has a magnet compartment disposed adjacent to a side periphery thereof. The magnet is disposed in the magnet compartment. The magnet provides a magnetic field away from the side periphery of the magnet housing. The coupler is configured for attaching an end of the magnet housing to an end of a writing implement. When the coupler is attached to a writing implement, the magnetic field enables the adaptor to magnetically support the writing implement from a side position.

The coupler can be a post-type coupler that can be press-fit by hand into a spoke style recess in a separate marker pen or other similar writing implement. The adaptor can be integrated into a cap structure for a marker pen or other similar writing implement. In such arrangement the coupler can includes a recess configured to receive the writing medium of the marker pen therein to also keep the writing medium from drying out. The magnet housing can be located between the tip of the writing medium and the tip of the cap style adaptor. The coupler could also include a recess configured to receive an end of a maker pen opposite the end having the writing medium, e.g., being press-fit or slip fit over the opposite end. The coupler can comprises a clamp or other locking structure that can friction fit onto an outside or other surface of the marker pen or writing implement. Other similar locking structures can be employed to connect a separate adaptor to a marker pen or writing implement. The coupler can be eliminated with the magnet housing and the magnet integrated into a housing that also encloses the writing medium of the maker pen or writing implement. In such embodiment, the magnet housing and magnet adapt the maker pen or writing implement into which they are integrated to be self-supporting on a whiteboard, glassboard or similar writing surface structure.

In another embodiment, an apparatus is provided for connecting a writing implement to a glassboard, whiteboard or the like. The apparatus has a magnet housing adapted to be connected to a writing implement. The magnet housing has a side surface with an opening formed therein and a recess extending from the opening into the housing. The magnet is disposed in the recess and provides a magnetic field in a direction away from the side surface of the magnet housing. For example, one or more poles can be provided at one or more openings from which the recess extends. The magnet enables a side periphery of a writing implement coupled with the apparatus to magnetically couple with the glassboard, whiteboard or the like in a predetermined orientation regardless of the initial orientation of approach of the writing implement.

In another embodiment, a writing implement is provided that includes a distal end, a proximal end, a housing and a magnet coupled with the housing. The housing has an elongate hollow structure that has a side surface surrounding a cavity. A writing medium is coupled with the housing, e.g., is disposed within the cavity, and exposed at the distal end. The magnetic coupled with the housing and having a pole located along the side surface of the housing.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments. The following is a brief description of each of the drawings.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Figure 1:
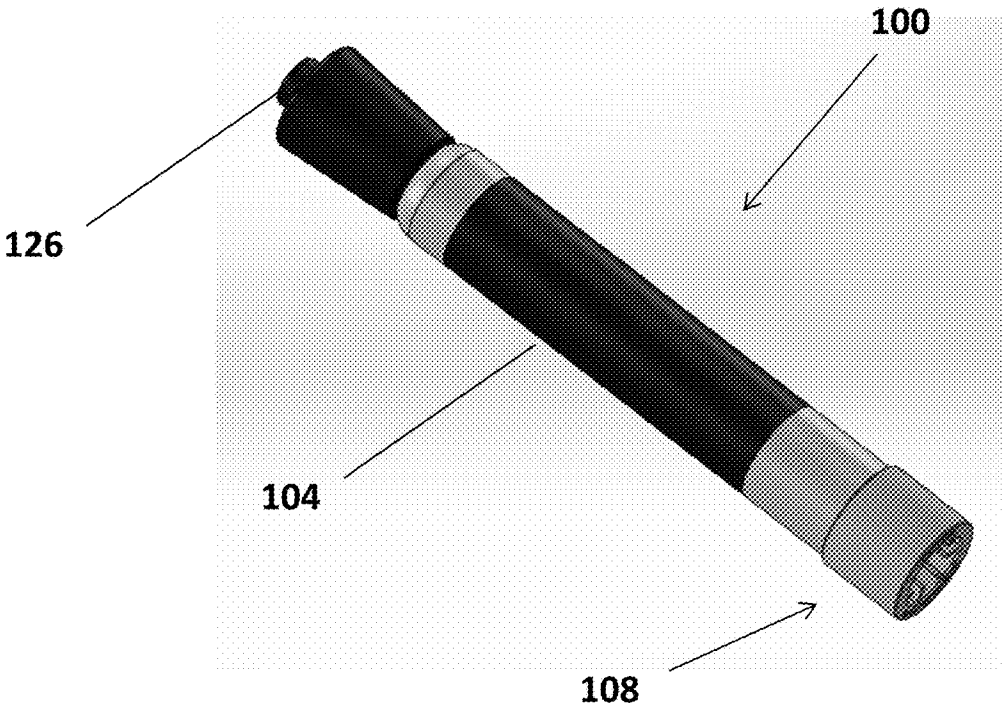
FIG. 1 is a perspective view of one embodiment of an adaptor coupled a dry erase marker, which is one embodiment of a writing implement.

FIG. 1 shows a marker assembly 100 that is able to be conveniently secured to a glassboard, whiteboard or the like (sometimes referred to collectively as "boards"). The marker assembly 100 includes a dry erase marker 104 and an adaptor 108 that enables the assembly 100 to automatically connect to a ferrous structure without regard to initial angle of approach, as will be discussed in greater detail below, and in some cases to self-orient writing-tip down. The assembly 100 has particularly advantageous application to glassboards and other multilayer structures where a ferrous layer is disposed behind a non-ferrous layer of significant depth.

The writing implement assembly 100 includes a dry erase marker 104 but can include any writing implement that might be of use on or with a board. The marker 104 can include a cylindrical housing extending between a proximal and distal end of the writing implement and an ink cartridge or similar structure partly disposed in the housing and partly exposed at the distal end of the writing implement. The ink structure leaves visible marks upon contact with a writing surface of the board. The marker can include a cap, as illustrated, for covering the exposed portion of the writing tip.

Figure 2:
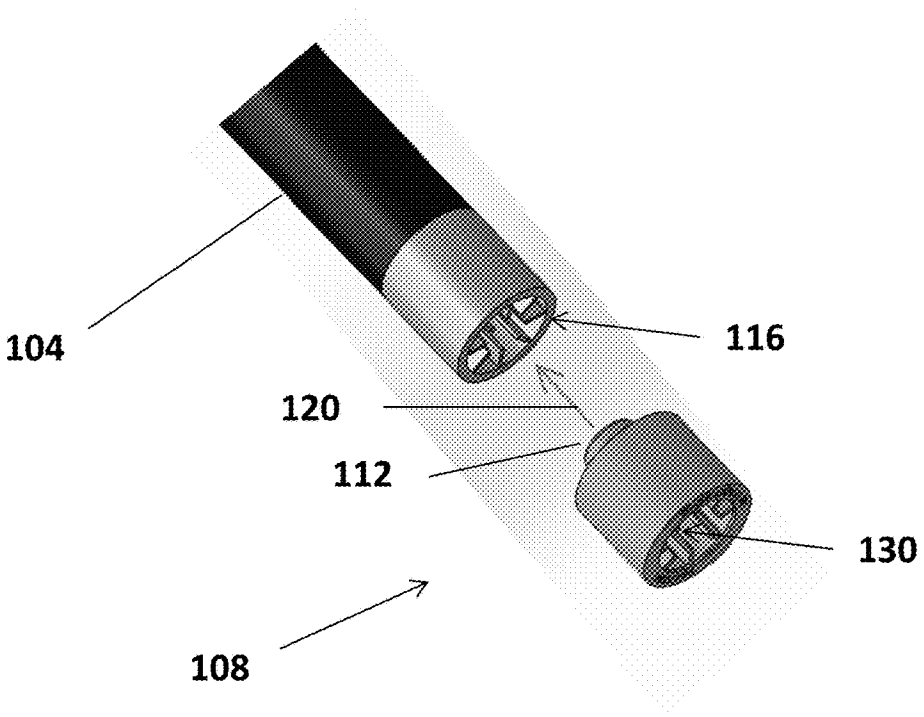
FIG. 2 shows one technique for coupling the adaptor with a proximal or non-ink end of the dry erase marker to form an assembly.

FIGS. 1 and 2 show that the adapter 108 can be configured as a separate or separable component form the marker 104. FIG. 2 also shows that one technique for connecting the adaptor 108 to the marker 104 involves moving a distal projection 112 into a recess 116 of the marker 104 along the direction of the arrow 120. The distal projection 112 can be a post configured to be press-fit by hand force into a spoke structure in the recess 116. FIG. 2 shows that in one embodiment, the adaptor 108 has a recess 130 with a spoke structure that is able to be coupled with a distal projection 126 or post of the cap (or other distal portion) of the marker 104. In one embodiment, the adaptor 108 includes the projection 112 and the recess 130, but in some embodiments one of these features is omitted. The separability of the adaptor 108 from the marker 104 enables the adaptor 108 to be reused which is useful because components of the adaptor 108 are expected to have a much longer useful life than those of the marker 104. But, features of the adaptor 108 can be integrated into the marker 104 and not separable therefrom in certain embodiments as discussed herein.

Figure 3:
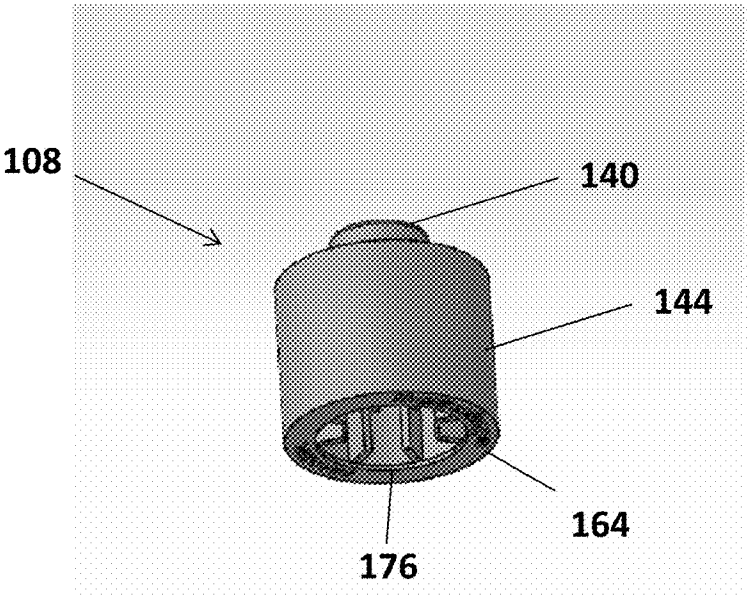
FIG. 3 is a bottom or proximal perspective view of the adaptor of FIGS. 1 and 2.
Figure 4:
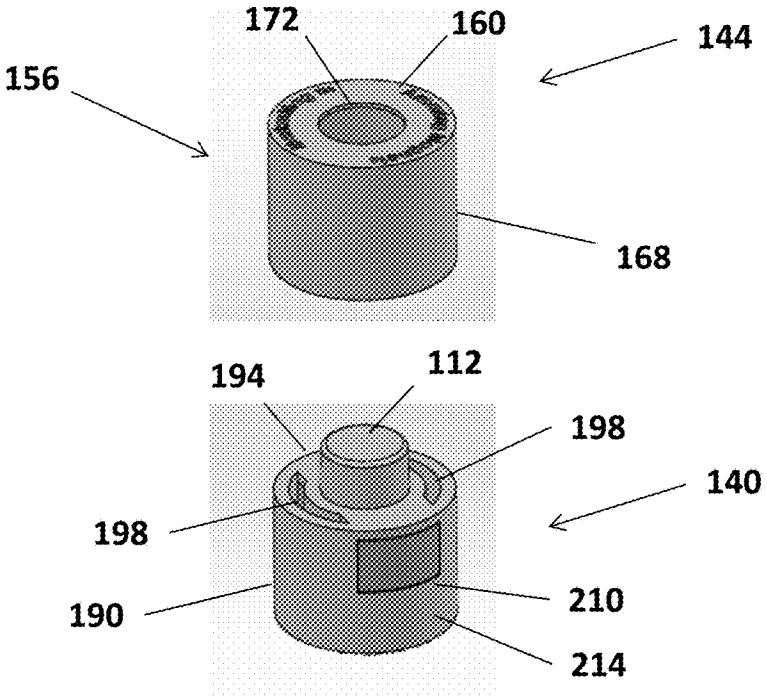
FIG. 4 is an exploded view of the adaptor of FIG. 3 showing a cover having a friction layer removed from a core assembly.

FIGS. 3 and 4 show further details of one embodiment of the adaptor 108, which includes a core assembly 140 and a sleeve 144 disposed about the core assembly 140. The core assembly 140 includes a magnet housing 148 (See FIG. 7) and a magnet 152. The magnet 152 is received in the magnet housing 148 and can be secured therein by an adhesive or other structure or devices, such as mechanical locking features, a close fit such as interference fit or the like.

The sleeve 144 can take any suitable form, but preferably is sized to be disposed over the magnet housing 148. The sleeve 144 can have a cylindrical structure with a distal or top shoulder 160 and a proximal or bottom shoulder 164 (see FIG. 3). The cylindrical structure can have an outside cylindrical surface 168 and an inside cylindrical surface (not shown). The outside cylindrical surface 168 preferably comprises a friction layer that enhances the engagement of the adaptor 108 with a board, as discussed further below. The inside cylindrical surface of the sleeve 144 is sized to receive the magnet housing 148 without excessive stretch but in a manner that prevents relative rotation of the magnet housing and the sleeve. The top shoulder 160 has an annular structure that extends oriented inward form the cylindrical surface 168 to an inner periphery 172. The shoulder 160 has a width that extends from the outer cylindrical surface 168 to the inner periphery 172. This distance preferably is sufficient to cover a distal shoulder of the magnet housing 148. The inner periphery 172 of the shoulder 160 is preferably sized to permit the distal projection 112 of the adaptor 108 to extend therethrough.

The bottom shoulder 164 has an annular structure that extends oriented inward form the cylindrical surface 168 to an inner periphery 176. The shoulder 164 has a width that is the distance from the outer cylindrical surface 168 to the inner periphery 176. The width of the shoulder 168 is selected to provide access to the recess 130 if provided.

FIGS. 4-7 shows features of the core assembly 140 and its components. The magnet housing 148 includes a rigid body that can be molded from a suitable polymer, such as Acrylonitrile-Butadiene-Styrene (ABS) plastic. Other materials and processes can be used. In the molded part there can be a cylindrical structure 190 that extends from a proximal or bottom end of the housing 148 to a distal facing shoulder 194. The distal facing shoulder 194 can be perforated with one or a plurality of openings 198 extending proximally of the shoulder. The projection 112 can be disposed on and project distally of the distal facing shoulder 194. The projection 112 can be a hollow unitary body extension of a portion of the distal facing shoulder 194.

Figure 5:
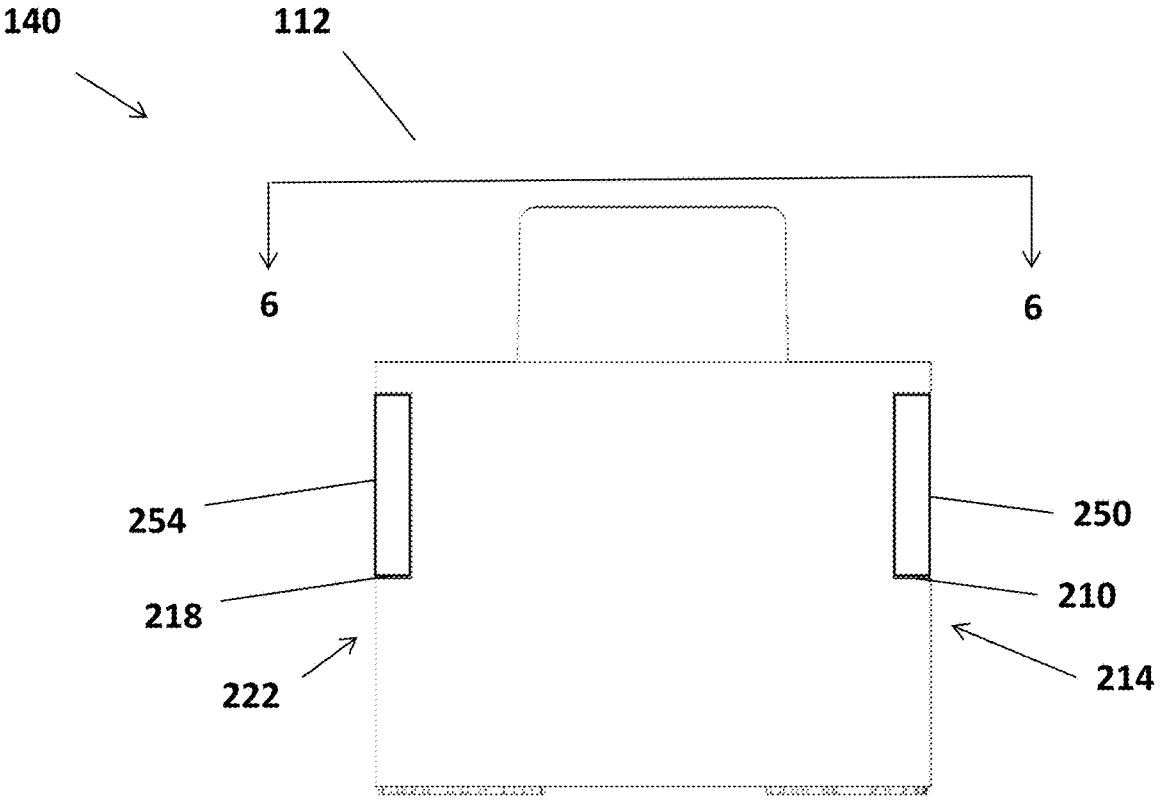
FIG. 5 is a side view of the core assembly showing two exposed poles of a magnet disposed in a core member.
Figure 6:
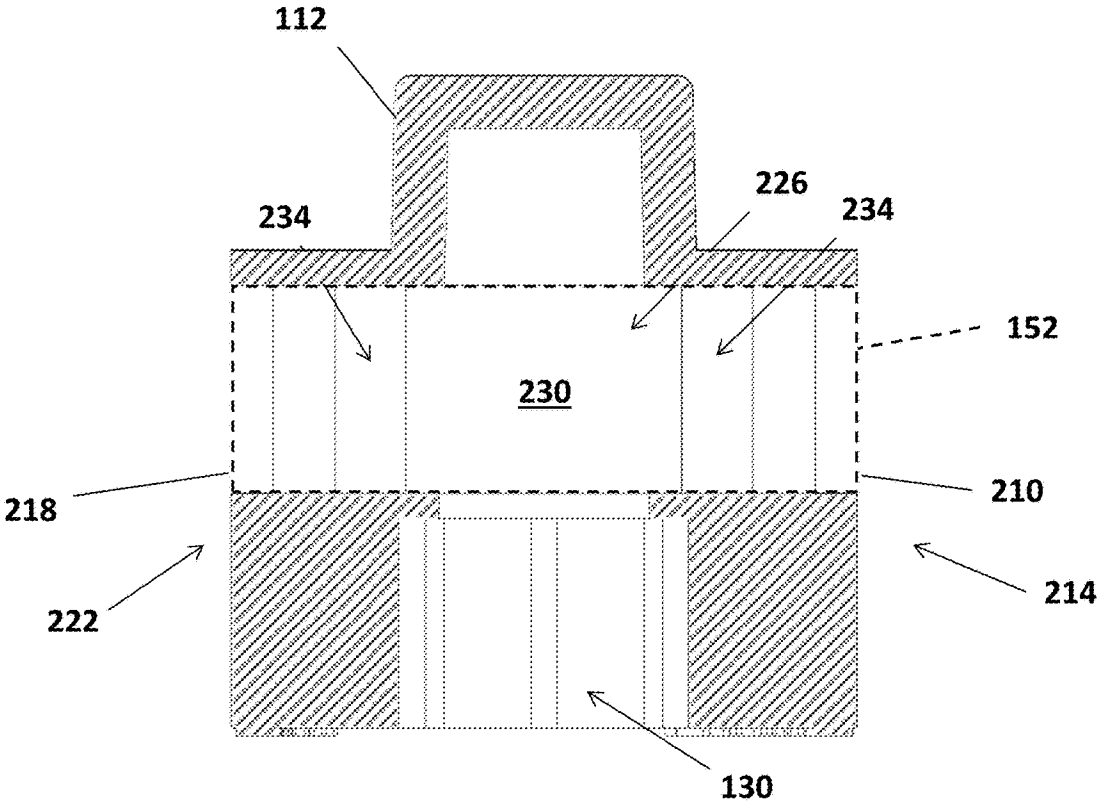
FIG. 6 is a cross-sectional view of the core member of FIG. 5 along the section plane 6-6, showing one embodiment of the magnet in dash lines.
Figure 7:
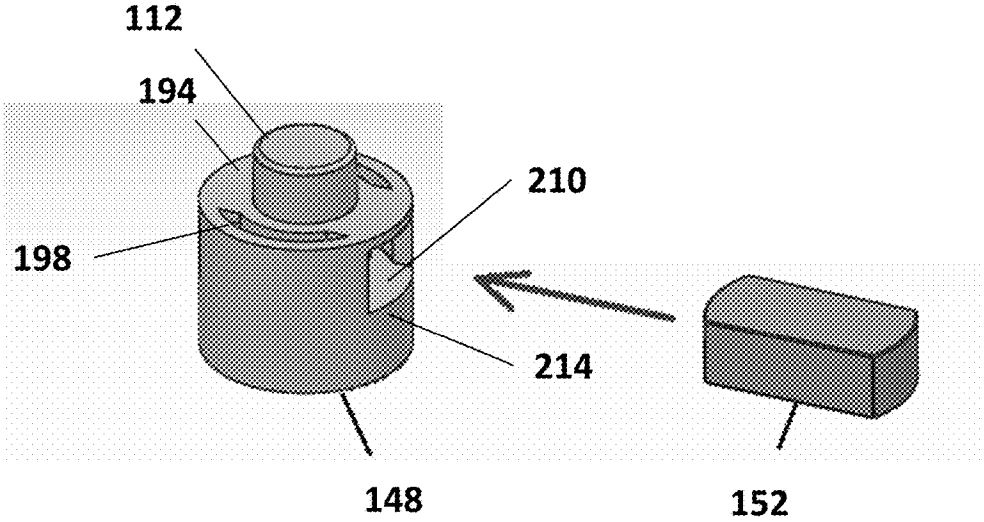
FIG. 7 is a exploded view of the core assembly shown in FIG. 5 showing one embodiment of the magnet separate from the core member.

FIGS. 5-7 show that in some embodiments an opening 210 is provided along a first side surface 214 and a second opening 218 is provided along a second side surface 222 of the cylindrical structure 190. FIG. 6 shows that a recess 226 can extend from the first side opening 210 into the magnet housing 148. FIG. 6 shows that the recess 226 can extend from the second side opening 218 into the magnet housing 148. In some embodiment, the recess 226 extends from the first side opening 210 to the second side opening 218 such that the recess 226 extends entirely across the housing 148. The recess 226 can be located in an intermediate portion of the housing 148. For example, the recess 226 can be located between a distal portion including the projection 112 and a proximal portion including the recess 130.

In one embodiment, the intermediate portion of the magnet housing 148 also includes a plurality of walls 230 disposed on opposite sides of a central zone of the recess 226. The walls 230 connect the distal and proximal portions of the magnet housing 148 to each other. The magnet housing 148 can have one or more channels 234 disposed between the walls 230 and the nearest outer wall of the cylindrical structure 190. The channels 234 can have an annular shape and can be disposed about the walls 230 in one embodiment. The channels 234 preferably are connected to the openings 198 disposed on the distally facing shoulder 194.

Figure 10:
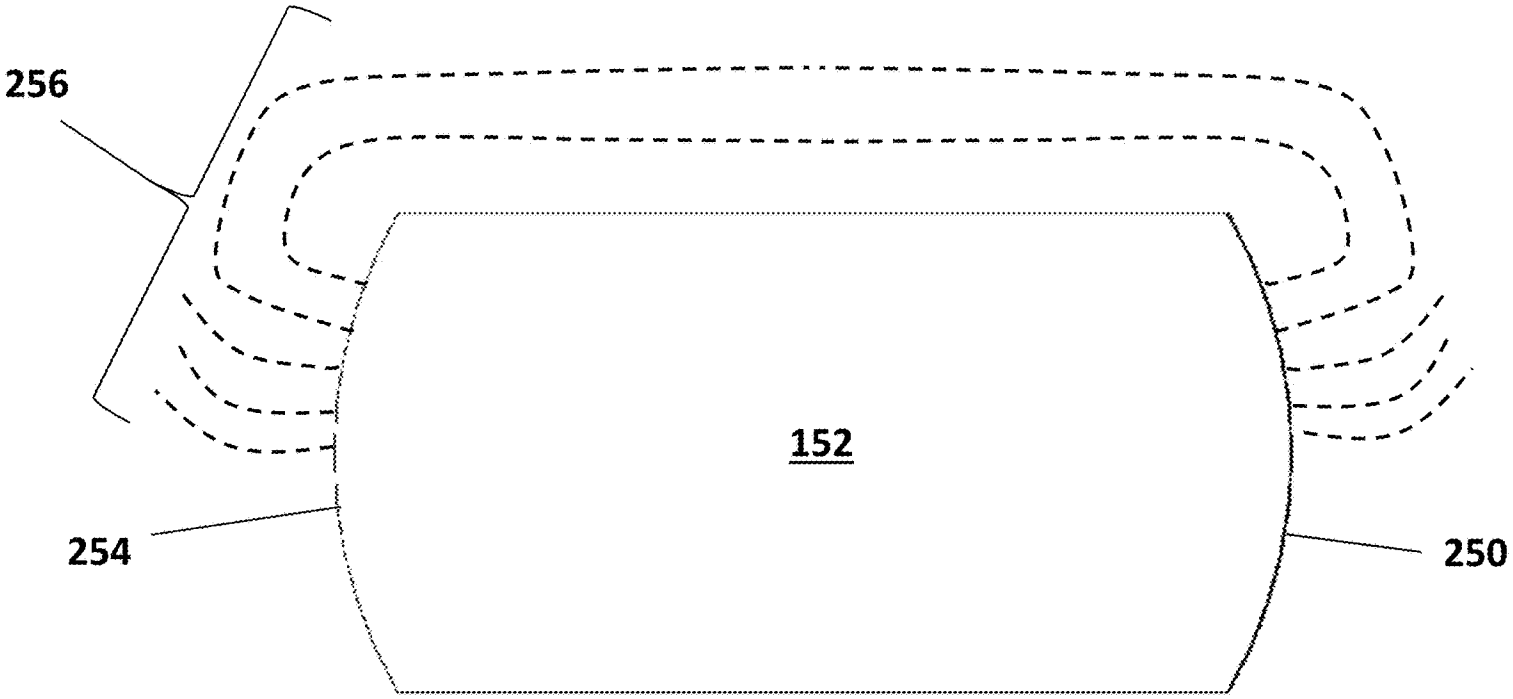
FIG. 10 is a top plan view of the magnet of the adaptors of FIGS. 3 and 8, schematically illustrating the magnetic flux produced thereby.

FIG. 6 shows the position of the magnet 152 in the magnet housing 148 in dashed lines for better illustrating of other components. The magnet is disposed in the recess 226. The magnet housing 148 and the recess 226 are an example of a magnet compartment. FIG. 10 shows further details of the magnet 152. In particular, the magnet includes a first pole 250 and a second pole 254 in one embodiment. The first pole 250 can include an arcuate structure. FIGS. 7 and 10 collectively show that the first pole 250 can have a partial cylindrical surface. The first pole 250 can be formed on a cylindrical surface having a constant radius and can have a height corresponding to the height of the magnet 152. The magnet 152 is preferably elongate, such that the poles 250, 254 are spaced apart by a distance corresponding to the length of the magnet 152. The configuration of the magnet 152 is preferably selected to provide sufficient strength to hold a writing implement on a board and may be further configured to automatically orient the adaptor 108 and the assembly 100 in more than one degree of freedom regardless of the initial approach of the assembly 100 to the board. The strength of the magnet 152 can be provided by any suitable approach, for example by providing a length or spacing the poles 250, 254 apart by a sufficient distance. In one embodiment, the length of the magnet 152 is about ¾ inch. The magnet can be between about ⅛ inch and about 2 inches in length. The thickness of the magnet can also be selected as needed to provide appropriate strength for the application in question.

In certain embodiments the magnet 152 is configured such that a sufficiently strong magnetic field is provided between the poles 250, 254 to support the adaptor 108 and an assembly 100 on a board. In certain cases, the magnet 152 can have a BHmax between 25 MGOe and 60 MGOe. In certain cases, the magnet 152 can have an externally measurable magnetic field between about 500 Gauss and about 1500 Gauss or between about 500 Gauss and about 3000 Gauss or between about 500 Gauss and about 10000 Gauss. In certain cases, the magnet 152 can have an externally measurable magnetic field between about 3000 Gauss and about 10000 Gauss. In certain embodiments, the magnet 152 can have a BHmax between about 2 MGOe and about 15 MGOe or between about 2 and about 25 MGOe. In certain embodiments, the magnet 152 can have a BHmax between about 25 MGOe and about 60 MGOe and an externally measurable magnetic field between about 3000 Gauss and about 10000 Gauss.

FIG. 10 illustrates a magnetic field 256 generated by the magnet 152. Just a few flux lines are shown to illustrate the field 256. Two flux lines are shown continuously extending between the poles 250, 254. Three additional flux lines are shown as emanating from the poles but the intervening portions of these flux lines have been omitted to simplify the drawing. But one skilled in the art will know that each line of the flux lines extends entirely between pole 250 and pole 254. In this case, the magnet 152 is configured such that the flux 256 is focused in the plane of the magnet, meaning that field lines can be represented as emanating from the poles 250, 254 and being disposed generally between the planes of the top and bottom surfaces of the magnet 152. This configuration focuses the attractive force of the magnet 152 to the two poles 250, 254. This arrangement is useful in automatically orienting the adaptor 108 with respect to ferrous structures of a board, as discussed below.

The magnet 152 can be secured in the magnet housing 148 in any suitable technique. FIG. 7 illustrates one approach in which the magnet 152 is advanced into the first opening 210. One of the poles 254, 250 can be advanced into the opening 210 first. Then the length of the magnet 152 can be advanced though the opening 210 until the initially inserted pole is disposed at the opening 218. An approach for securing the magnet 152 in the recess 226 involve placing adhesive to bridge between the magnet housing 148 and the magnet 152. During assembly, e.g., after or before the magnet 152 is placed in the recess 226, an adhesive can be directed through the openings 198 into the channels 234 to bond to the magnet 152 and the magnet housing 148. The bonding to the magnet 152 can be at the locations where the channels 234 meet the recess 226. The bonding to the magnet housing 148 can along the walls of the channels 234.

The width of the distal shoulder 160 of the sleeve 144 preferably is large enough to cover the openings 198 such that after the adhesive has been dispensed into the channels 234 the openings 198 can be covered. In other embodiments, the sleeve 144 is omitted and the openings 198 maybe filled such that the adhesive is flush with the distal facing shoulder 194 of the magnet housing 148.

FIG. 5 shows that in certain embodiments, a flush configuration is provided between the pole 250 and the side surface 214 and the pole 254 and the side surface 222. The flush configuration is provided in part by forming the poles 250, 254 with the same radius of curvature as that of the side surfaces 214, 222. For example, if the magnet housing 148 comprises a cylindrical body, the cylindrical body and the magnet poles 250, 254 can have the same radius of curvature. Also, if both poles 250, 254 are exposed the magnet 152 can have a length such that it extends all the way across the magnet housing 148 from the first side surface 214 to the second side surface 222. The flush configuration provides several advantages. First, the magnet length can be increased or maximized, which allows the strength of the magnet to be increased or maximized. Stronger magnets can be used in more applications, such as in glassboards as discussed below. Second, the flush mounting allows the strongest part of the magnetic field to be closest to the surface of the adaptor 108. Because field strength decreases over distance, providing the magnet 152 recessed in or completely encapsulated in the magnet housing 148 reduces the ability of the adaptor 108 to secure to remote structures. By preventing the magnet 152 from protruding from the magnet housing 148, the adaptor 108 is more streamlined not presenting any protuberances to the user that could scratch a board or otherwise be disruptive to use. Where both poles 250, 254 are disposed in a flush manner at a surface of the magnet housing 148 the adaptor 108 is provided with a plurality of preferred engagement positions, which is useful for automatically aligning the assembly 100 with a board as discussed below.

Figure 11:
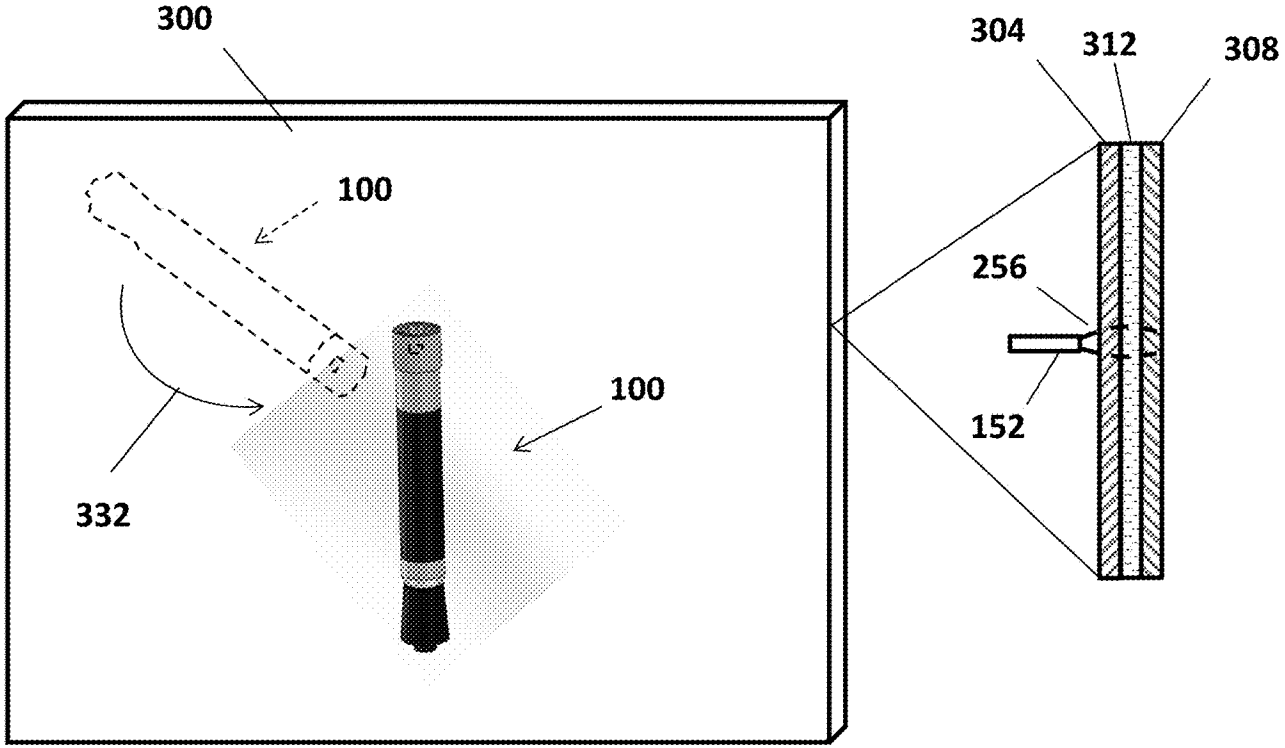
FIG. 11 illustrates various advantageous features of the adaptors of FIGS. 3 and 8 and a writing implement coupled therewith, including a self-orienting writing-tip down capability.
Figure 12:
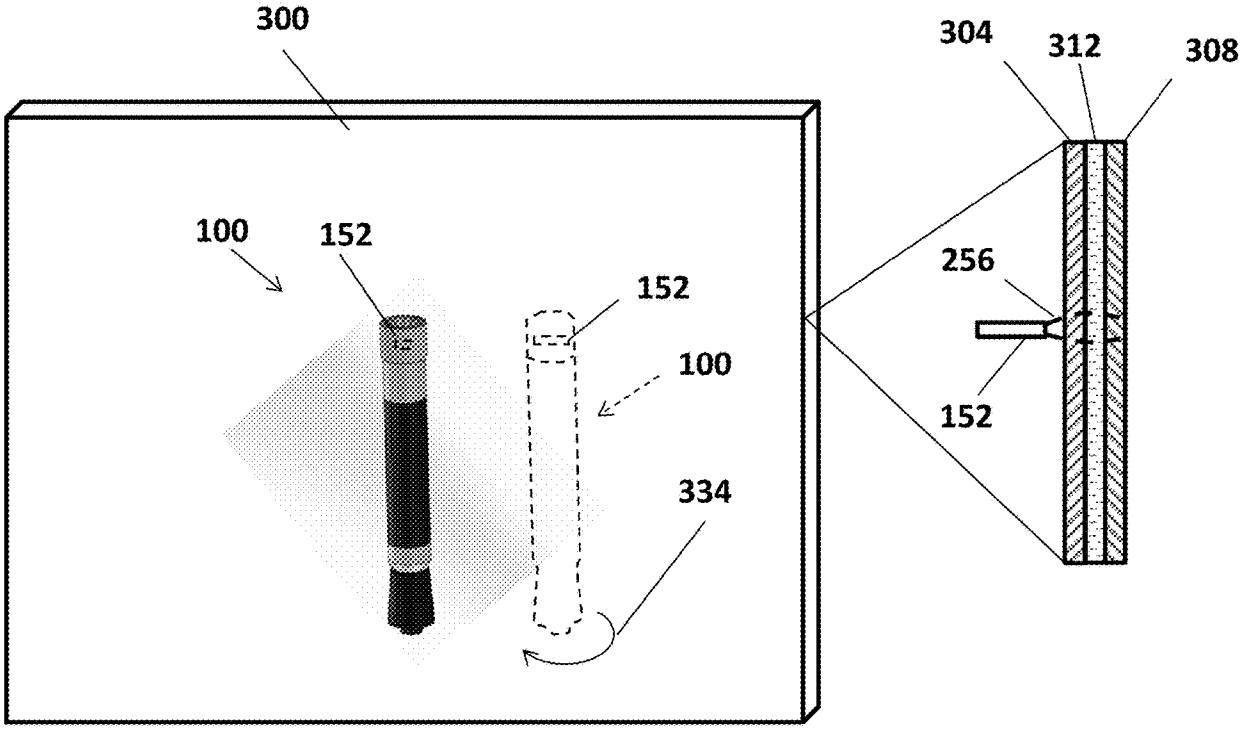
FIG. 12 illustrates a self-orienting capacity by which the adaptors automatically turn to the orientation of greatest magnetic strength.

FIGS. 10-12 illustrate some of the advantageous modes of use of the adaptor 108 and the assembly 100 in which it can be included. As noted above, FIG. 10 shows the magnetic field lines that emit from the magnet 152. This field is stronger than typical refrigerator magnets. The magnet 152 may be formed from a rare earth material, such as neodymium (NdFeB) and equivalent variants. FIG. 11 shows one type of board 300 for which the adaptor 108 is particularly well suited. The board 300 has multiple layers, including an exposed layer 304 adapted for being written on by the marker 104 and ferrous layer 308. An intervening layer 312 is shown, and may include an adhesive or in fact more than one layer for other purposes. In some cases, the ferrous layer 308 and the exposed layer are immediately adjacent to each other. In some boards 300, the exposed layer is a layer of glass having a thickness of about one-eight inch or more, e.g., up to about one-half inch or more. In some applications, the board 300 the exposed layer is a white coating layer applied directly to the ferrous layer 308.

In one application the assembly 100 can be coupled with a whiteboard, which can have a ferrous metal, e.g., steel, with a thickness between about 0.003 inch and about 0.25 inch. The ferrous metal may be coated but otherwise direct contact can be provided between the assembly 100 and the ferrous metal. Any type of magnetic material having between about 5 MGOe and about 25 MGOe and measurable surface gauss between about 1 and about 3000 can be used for the magnet 152. In another application, the assembly 100 can be coupled with a glassboard having a non-ferrous material with thickness between ⅛ inch to ½ inch with ferrous backing with a thickness of about 0.003 inch to about 0.25 inch. In the glassboard applications, a magnetic material between about 25 MGOe and about 60 MGOe or higher, and measurable surface gauss between about 3000 and about 10000 Gauss or higher can be used.

FIGS. 11 and 12 also show the magnetic field 256 in the context of the board 300. The magnetic field 256 extends in a direction away from the side surface of the magnet housing 148 and can extend into the board 300 in use. The field 256 is illustrated for simplicity by one dashed line from each pole in these figures, though as noted above the magnetic field generated by the magnet 152 is strong and would correspond to a highly dense arrangement of flux lines. The field 256 is also shown in the inset image, as extending from the poles of the magnet 152 through one or more layers to the ferrous layer 308. In the inset image the magnet 152 is shown alone for ease of illustration, but would be coupled with the adaptor 108 and the marker pen 104 or other writing implement in use.

The adaptor 108 enables a side periphery of the marker pen 104 or other writing implement coupled therewith to couple with the board 300 in a low profile manner, e.g., with the longitudinal axis of assembly 100 or marker pen 104 to be aligned with, e.g., parallel to the plane of the exposed surface 304. This arrangement advantageously minimizes the distance that the marker pen 104 extends out from the surface 304 in the space in which the board 300 is located. By minimizing this distance the pen 104 and assembly 100 are out of the way when not in use.

The adaptor 108 advantageously enables the assembly 100 to magnetically couple with the board 300 in a predetermined orientation regardless of the initial orientation of approach of the writing implement. For example, FIG. 11 shows a dashed line outline of the assembly 100 placed against the board 300 in an orientation where the writing end is up. That is, a cap of the marker 104 is disposed at an elevation above the adaptor 108. In this example, the magnet 152 is already oriented in a direction providing the strongest field into the board across the exposed layer 304 to the ferrous layer 308. That is, the long axis of the magnet is disposed perpendicular to the board 300. The adaptor 108 is configured to permit the writing end of the marker 104 to rotate down as indicated by the arrow 332 to the writing-tip down position shown in solid lines in connection with the assembly 100. For example, the magnet 152 can be made strong enough to securely couple the assembly 100 with the board 300 but not so strong that the pen is not permitted to swing down to the writing-tip down position, as indicated by the arrow 332. The rotation indicated by arrow 332 is about an axis perpendicular to the board 300 and extending generally through the intermediate portion of the housing 148.

FIG. 12 shows another scenario where a side periphery of the marker 104 or other writing implement coupled with the adaptor 108 to magnetically couple with the board 300 in a predetermined orientation regardless of the initial orientation of approach of the writing implement. In particular, the assembly 100 is oriented so that the longitudinal axis of the magnet 152 (e.g., the axis extending between the poles 250, 254) is not perpendicular to, e.g., is parallel to the plane of the exposed surface 304 or the ferrous layer 308. The magnet 152 is most strongly magnetically coupled with the board 300 when the long axis of the magnet 152 is perpendicular to the ferrous layer 308 of the board 300. The magnet 152 is made strong enough that it will cause the assembly 100 to self-rotate to align to the strongest magnetic coupling orientation. In the figure the arrow 334 illustrates rotation of the assembly 100 from the weak engagement position (in dash) to the strongengagement position (in solid lines). This rotation is due to the configuration of the magnet 152, including the strength and arrangement of the magnet 152 in the housing 148. Aspects of the arrangement of the magnet 152 that facilitate this include the exposed, flush oriented poles 250, 254 and the elongate magnet structure. The rotation indicated by arrow 334 causes the marker 304 to turn about its longitudinal axis so that the long axis of the magnet 152 changes its orientation from parallel (in dash) to perpendicular to the board (in solid). Of course, the rotations 330 and 334 can both happen depending on the initial orientation of approach of the assembly 100 to the board 300.

Another advantage of arrangements with a plurality of, e.g., two, three, four, five, or six or more, exposed poles is the amount of rotation required according to the arrow 334 is reduced. In the two pole arrangement of FIG. 5, the adaptor 108 and assembly 100 can orient to the correct position according to the arrow 334 by rotating less than 180 degrees, e.g., less than 90 degrees about the longitudinal axis of the assembly 100. This allows the assembly 100 to quickly orient to a position in which the marker pen 104 can be supported on the board 300. As noted above, the rotational orientation can be coordinated with an elevational orientation to position the marker pen 104 in an writing-tip down position.

Although the description of the assembly 100 includes the advantageous separability of the adaptor 108 from the marker 104, it is possible to integrate the adaptor into the marker 104 in another assembly. In the integrated form, the magnet 152 can be disposed in the same housing or cylinder in which the ink of the marker 104 is disposed. Such arrangement has the advantage of not requiring end-user assembly. Also, there is no possibility of the adaptor 108 being lost because it is already part of the marker 104. When configured as separable, the adaptor 108 can be reused when the ink in the marker 104 is consumed. Also, the adaptor 108 can be attached in another manner than inserting a post into a spoke-type recess as discussed elsewhere herein.

Figure 8:
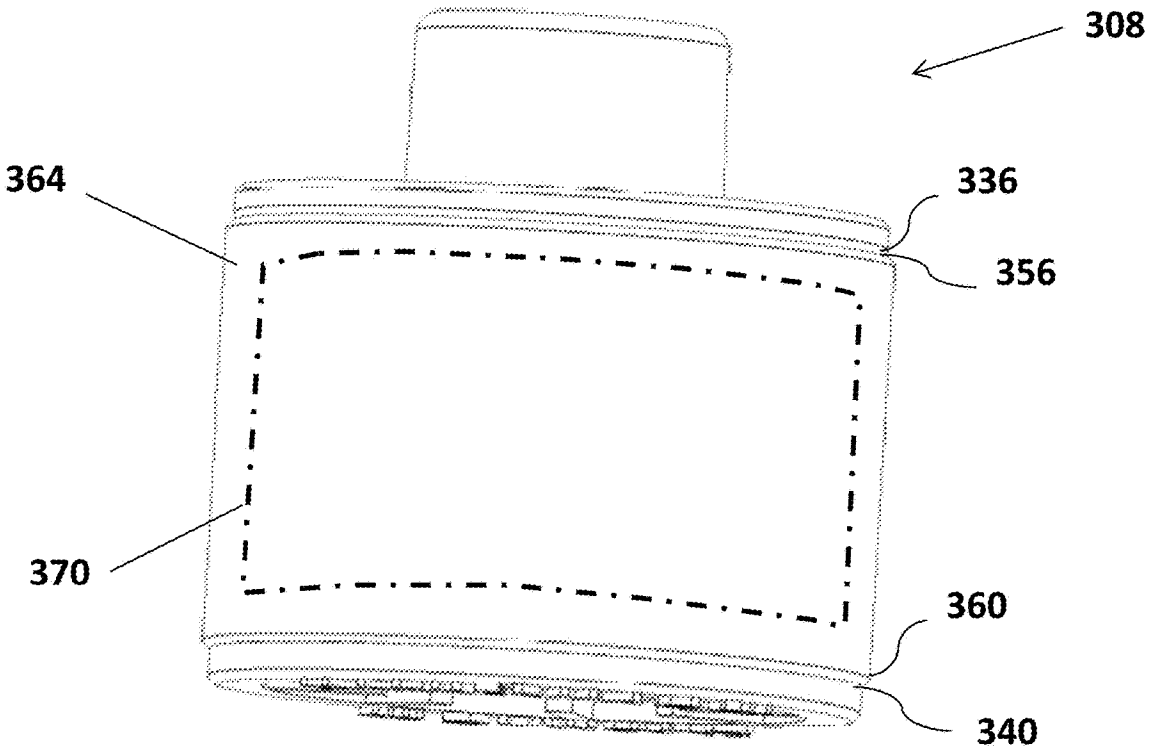
FIG. 8 is a bottom or proximal perspective view of another embodiment of an adaptor.
Figure 9:
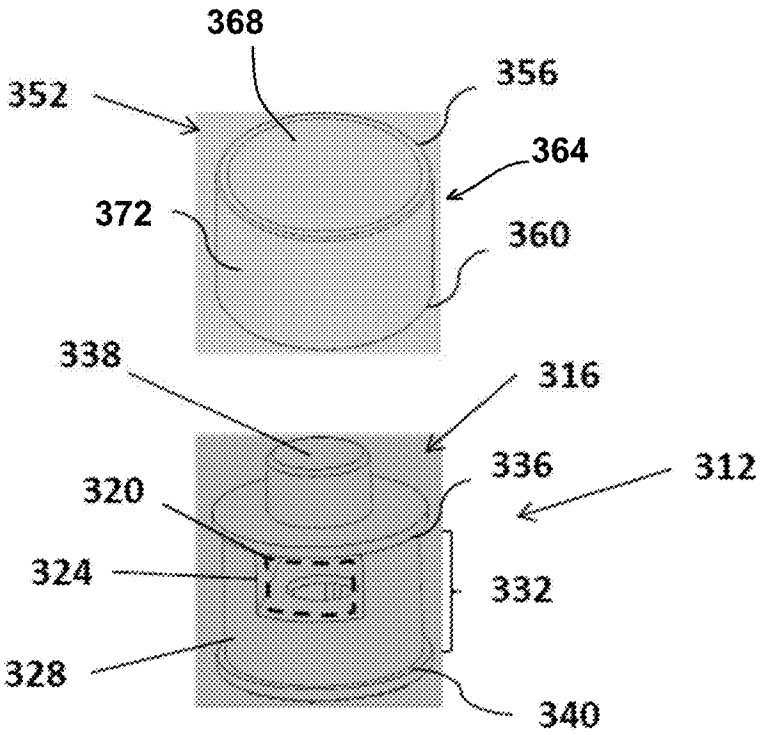
FIG. 9 is an exploded view of the adaptor of FIG. 8 showing a cover removed from a core assembly.

FIGS. 8 and 9 illustrate further embodiments of an adaptor 308. The adaptor 308 can have any feature disclosed in connection with the adaptor 108, except as described differently below. The adaptor 308 has a core assembly 312 that includes a magnet housing 316 and a magnet 320. The magnet 320 is disposed in a passage in the housing 316. The passage can extend from an opening 324 disposed on a side surface 328 of the housing 316.

The side surface 328 can include an annular recess 332 disposed therein. The annular recess 332 provides a stepped side profile in the housing 316. The annular recess 332 can be disposed between a first ledge 336 and a second ledge 340. The first ledge 336 can be located adjacent to an end projection 338 of the adapter 308. The second ledge 340 can be located between the first projection 336 and an end of the adaptor 308 opposite the projection 338. In one embodiment, the passage for the magnet 320 extends between openings on opposites sides of the annular recess 332. The magnet 320 can be configured to be flush with the surface of the annular recess 332 so that it is disposed radially inwardly of a cylinder defined by the radial extent of the ledges.

The adaptor 308 is thus configured to receive a sleeve 352 that is at least partially recessed in the magnet housing 316 of the core assembly 312. The sleeve 352 can take any suitable form, but preferably is flexible and has a first edge 356, a second edge 360 and a cylindrical portion 364 extending therebetween. The cylindrical portion 364 comprises an inside surface 368 and an outside surface 372. The adaptor 308 is configured such that the sleeve 352 can be placed over the magnet housing 316 such that the inside surface 368 is disposed on the side surface 328. FIG. 8 shows that when the sleeve 352 is so positioned, the first edge 356 preferably is disposed adjacent to the first ledge 336 and the second edge 360 preferably is disposed adjacent to the second ledge 340. The cylindrical portion 364 preferably is received in the annular recess located between the first ledge 336 and the second ledge 340.

Although the ledges 336, 340 can completely surround the side surface 328, in some embodiments, the ledges 336 and/or 340 can be configured as projections with a circumferential length that is less than the circumference of the side surface 328. It is also possible to provide that one of the ledges 336, 340 extends entirely around the magnet housing 316 and that one of the ledges 336, 340 comprises one or more short projections disposed only partly around the housing 316. The ledge(s) 336 and/or 340 provide the advantage of retaining the band 352 on the housing 316. That is an axial load on the band 352 will be resisted by the ledges 336, 340 such that the band does not inadvertently separate from the housing 316. This is important in assuring that the magnet 320 is retained in the housing 316.

The adaptor 308 is advantageous in providing for ease of assembly. In particular, the sleeve 352 can be easily applied to the magnet housing 316. For example, the sleeve 352 has a cylindrical form so that there are no radially inwardly projecting ends to be stretched over the ends of the magnet housing 316. The sleeve 352 is also easier to remove and replace as needed. For example, if the sleeve 352 became discolored or damaged it could easily and quickly be replaced. In some cases, the sleeve 352 may be in good condition, but it may be desirable to change the color. For example, the color of the sleeve 352 can be changed to match the color of the ink in the writing implement with which the adaptor 308 may be coupled. Also, removing the sleeve 352 provides access to the magnet 320 such that the magnet can be replaced. For example, in some applications a weaker magnet may be replaced for a stronger magnet. In other applications a stronger magnet may be replaced for a weaker magnet. Also, the sleeve 352 can optionally be configured with an information portion 370. The information portion 370 can include a promotional message, a company log, inspirational message, advertisement, or other markings. The informational portion 370 can be configured as an imprint or can include printing. Because the sleeve 352 is configured for ease of coupling with the magnet housing 316, theses markings can be easily exchanged for different uses or customers.

Also, even though it is very flexible and adaptable, the cylindrical sleeve 352 has the advantage of being very low cost both because it is low cost to produce and because it is low cost to assemble with the magnet housing 316. Although the embodiments herein have wide application it is anticipated that the price per-unit should be kept as low as possible to increase the marketability of the apparatuses.

The annular recess 332 also enables the sleeve 352 to be flush-mounted or only minimally radially protruding from the side surface 328 of the housing 316. This provides improved aesthetics because a continuous or smooth side profiler results.

Figure 13:
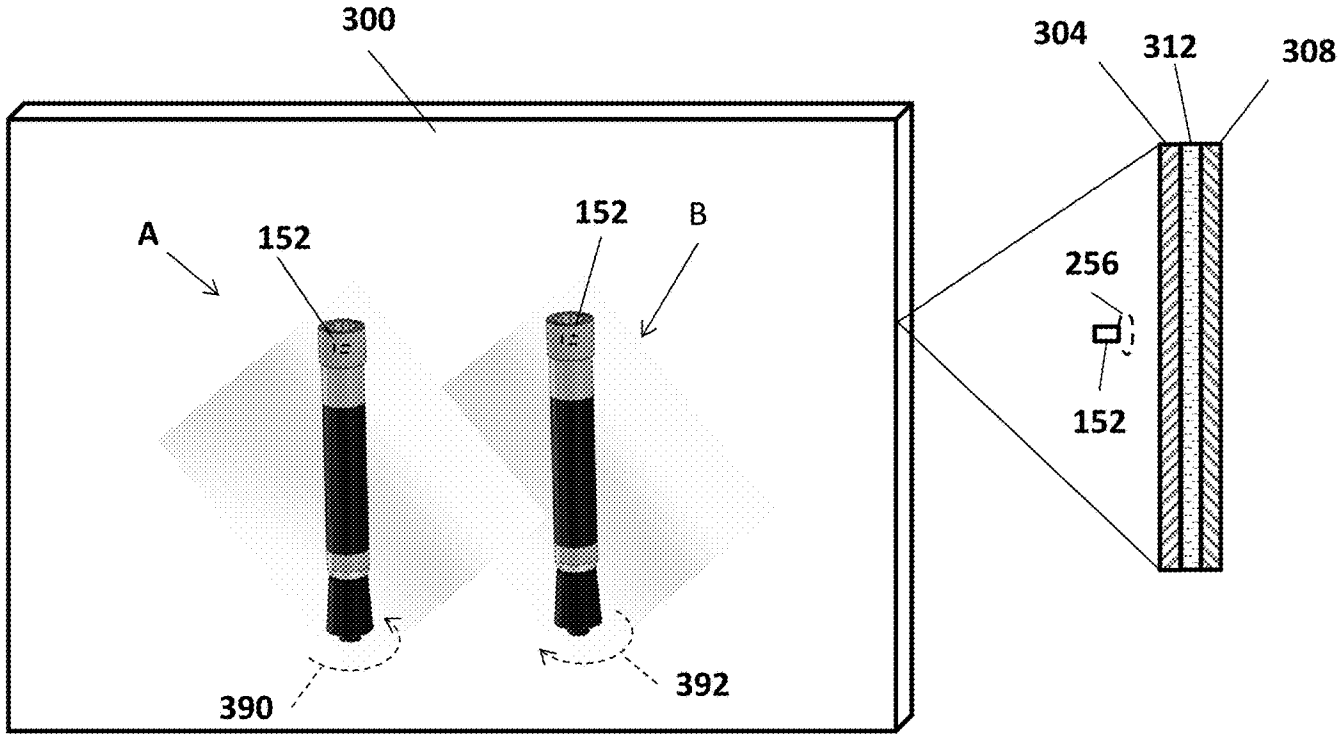
FIG. 13 is an illustration of a mis-aligning effect of two marker pen assemblies when placed adjacent to each other and to a white or glassboard.

FIG. 13 illustrates a further concern that can be addressed in certain situations where more than one marker assembly is present. For example, if a marker assembly A similar to the marker assembly 100 is placed on the board 300 and thereafter or at the same time a second marker assembly B is placed on the board 300 the markers A, B, can interact with each other. Specifically, a north pole of the magnet 152 in the marker assembly A can attract a south pole of the magnet 152 in the marker assembly B. This can cause the maker assembly A to rotate according to the direction 390 toward the marker assembly B. In some cases, this can also cause the maker assembly B to rotate according to the direction 392 toward the marker assembly A. FIG. 13 shows the effect of such rotation to the right of the board 300. Comparing the orientation of the magnet 152 in FIG. 12 with the orientation in FIG. 13, one can see that magnetic north and south are oriented parallel to the ferrous layer 308 (into and out of the page). This is illustrated by showing the small dimension of the magnet 152 being seen from the side of the board 300. The result is that the portion of the magnetic field 256 directed toward the board 300 is much less dense and less powerful. Compare the density of the field lines on the long side of the magnet 152, which is aligned with the board 300, in FIG. 10 with the flux lines at the ends of the magnet 152. In the worst case, one or both of the marker assemblies A, B lose their supportive magnetic attraction with the board 300 and will fall to the floor and can become lost or damaged.

Figure 14A:
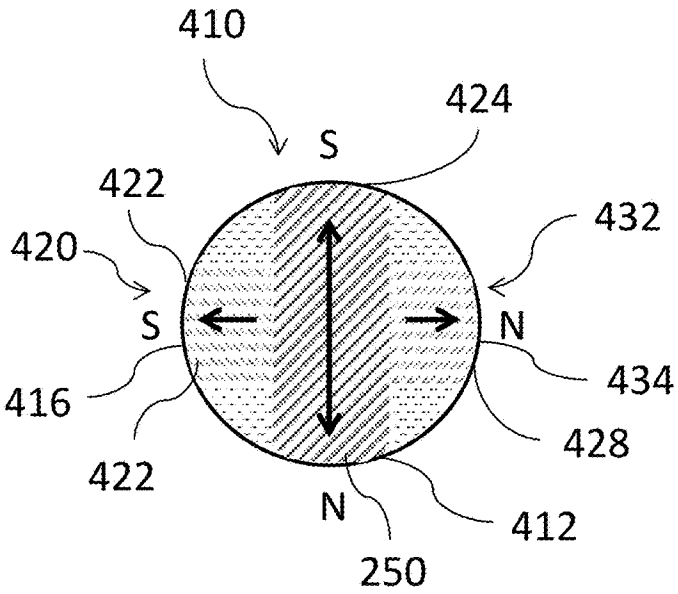
FIGS. 14-14(B) show a side, cross-sectional, and exploded view of another embodiment of an adaptor for a writing implement.
Figure 14:
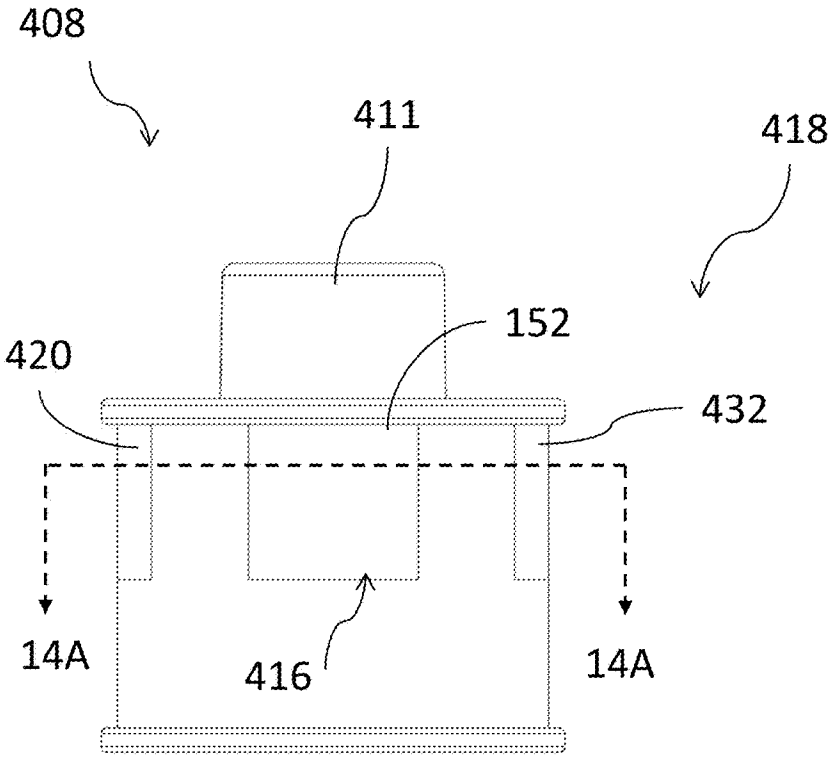
Figure 14B:
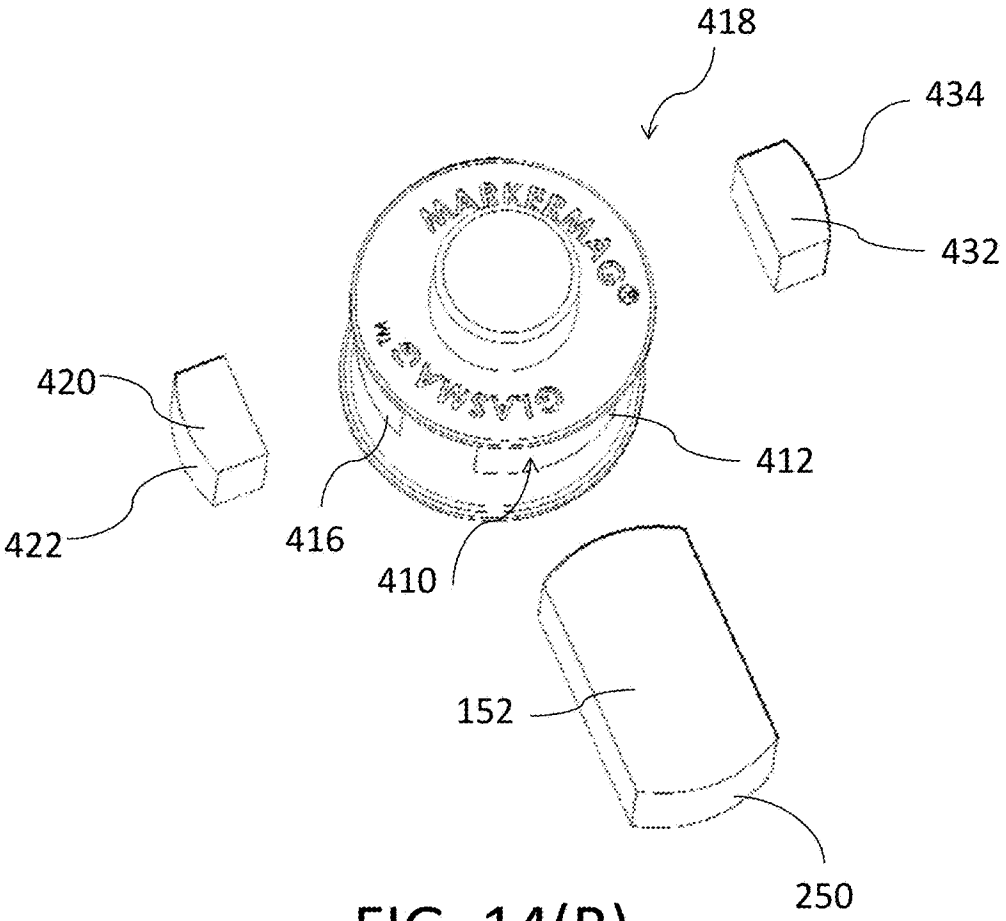

FIG. 14 shows an adaptor 408 that can be coupled with a dry erase marker or other writing implement. The adaptor 408 is similar to the adaptor 108 discussed above, except as described differently below. The adaptor 408 includes a magnet housing 418 and a post 411. The post 411 can be disposed at one end of the magnet housing 418 and a magnet compartment 410 can be disposed between the post 411 and the other end of the magnet housing 418. The post 411 can be configured to be received in the center of a spoke type end of a dry erase marker, e.g. by a hand secured interference fit, as discussed above.

Although disclosed in the context of an adaptor, aspects of the adaptor 408 can be incorporated into a marker pen or writing implement in other ways. For example, the magnet housing 418 and the magnets disposed therein can be built into an end of a marker or other writing implement in some embodiments. In other embodiment, the magnet housing 418 and the magnets disposed therein can be combined into a cap structure that slips over and covers an ink portion of a marker or other writing implement. Any other structure for mechanically coupling the adaptor 408 and or magnets therein to a maker or writing implement body can be used as well. For example, other press-fit and snap-fit configurations, or other connection mechanism as discussed herein, can be employed to couple the adaptor 408 and/or the magnets disposed therein into or onto existing markers or writing implements.

The magnet compartment 410 can extend from a first opening 412 disposed in a side surface of the magnet housing 418. In one embodiment, a second opening 416 is disposed in the magnet housing 418. The second opening 416 is located circumferentially adjacent to the first opening 412. The first opening 412 and the second opening 416 can be two openings into a continuous space comprising part of the magnet compartment 410. A third opening 424 can be formed in a side surface of the magnet housing 418. The third opening 424 can provide access to a space that is continuous with the space accessed by one or both of the first opening 412 and the second opening 416. The magnet housing 418 can include a fourth opening 428 disposed in a side surface thereof. The fourth opening 428 can provide access to a space that is continuous with the space accessed by one, two, of all of the first opening 412, second opening 416, and the third opening 424. Any one of these spaces can comprise a portion or all of the magnet compartment 410 FIG. 14(A) shows that in one embodiment, the magnet 152 can be disposed in the first opening 412 and the third opening 424. The magnet 152 can include a magnet extending entirely across the magnet housing 418. The magnet 152 is discussed in more detail above. The magnet 152 can have a first pole 250 at the first opening 412.

A second magnet 420 can be disposed in the second opening 416. The second magnet 420 can extend from the second opening 416 into a central region of the magnet housing 418. The second magnet 420 can have an exposed surface at the second opening 416. A first pole 422 can be located at the exposed end of the second magnet 420. The exposed surface of the second magnet 420 can be arcuate, e.g., following the curvature of the outside surface of the magnet housing 418. The second magnet 420 can be configured to extend only partway across the diameter of the magnet housing 418. The second magnet 420 can have an end opposite the first pole 422 that is disposed toward a central region of the magnet housing 418. In one embodiment the magnet compartment 410 is a continuous space. The end of the second magnet 420 disposed in the central area of the magnet housing 418 can be disposed against a side surface of the magnet 152.

A third magnet 432 can be placed in the magnet housing 418 with an exposed face thereof in the fourth opening 428. The third magnet 432 can be similar to the second magnet 420. The third magnet 432 can have a first pole 434 at the exposed surface. The shape of the exposed surface forming the first pole 434 of the third magnet 432 can be arcuate as in the case of the second magnet 420. The third magnet 432 can be integrated into the magnet housing 418 in the same manner as the second magnet 420. For example, the third magnet 432 can extend only partly across the magnet housing 418 in a continuous magnet compartment 410. The end of the third magnet 432 opposite the first pole 434 can be placed against, e.g., in contact with, the magnet 152. In other embodiments the magnet housing 418 can have discrete spaces for each one of a plurality of magnets, e.g., three discrete and isolated spaces one for each of the magnet 152, the second magnet 420, and the third magnet 432.

The polarity of the first pole 250 of the magnet 152, the first pole 422 of the second magnet 420, and the first pole 434 of the third magnet 432 can be arranged to control the positioning of two adaptors (or writing implements into which the magnets are integrated if an integral structure rather than an adaptor is provided) that are placed in proximity to each other while being in proximity to a whiteboard, glassboard, or the like. The polarity of the first pole 250 of the magnet 152 at the first opening 412 can be opposite to that of the first pole 422 of the second magnet 420 at the second opening 416. For instance, the first pole 250 can be a North pole and the first pole 422 can be a South pole. The polarity of the first pole 250 of the magnet 152 can be the same as the first pole 434 of the third magnet 432.

This polarity arrangement that the adaptor 408 and writing implement coupled therewith will be in a specific orientation to another like adaptor or writing implement if placed in close proximity to each other. If opposite poles of the magnet 152 of marker A and the marker B are aligned, the magnet 152 will attract each other but one of the second magnet 420 and the third magnet 432 on each of the markers A, B will face the white or glassboard or the like to self-support the marker pen. Similarly, any two opposing poles of the markers A, B will attract each other and will thereby orient other magnets toward the whiteboard, glassboard or the like to provide a self-supporting configuration.

Figure 15A:
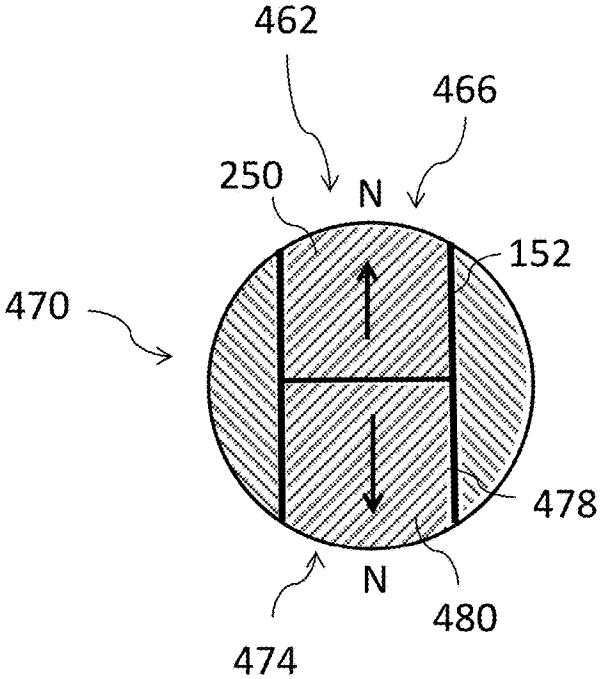
FIGS. 15-15(B) show a side, cross-sectional, and exploded view of another embodiment of an adaptor for a writing implement.
Figure 15:
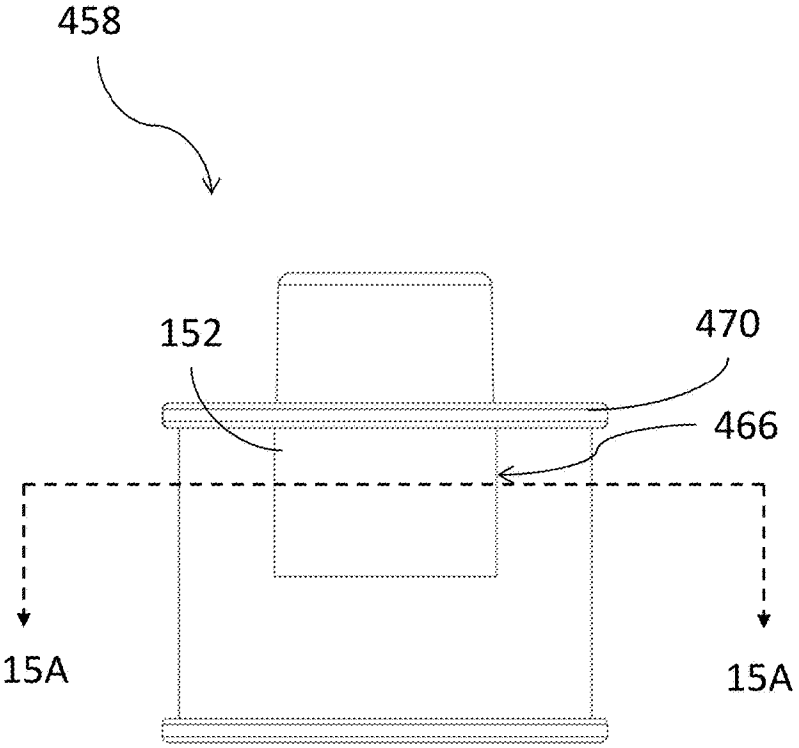
Figure 15B:
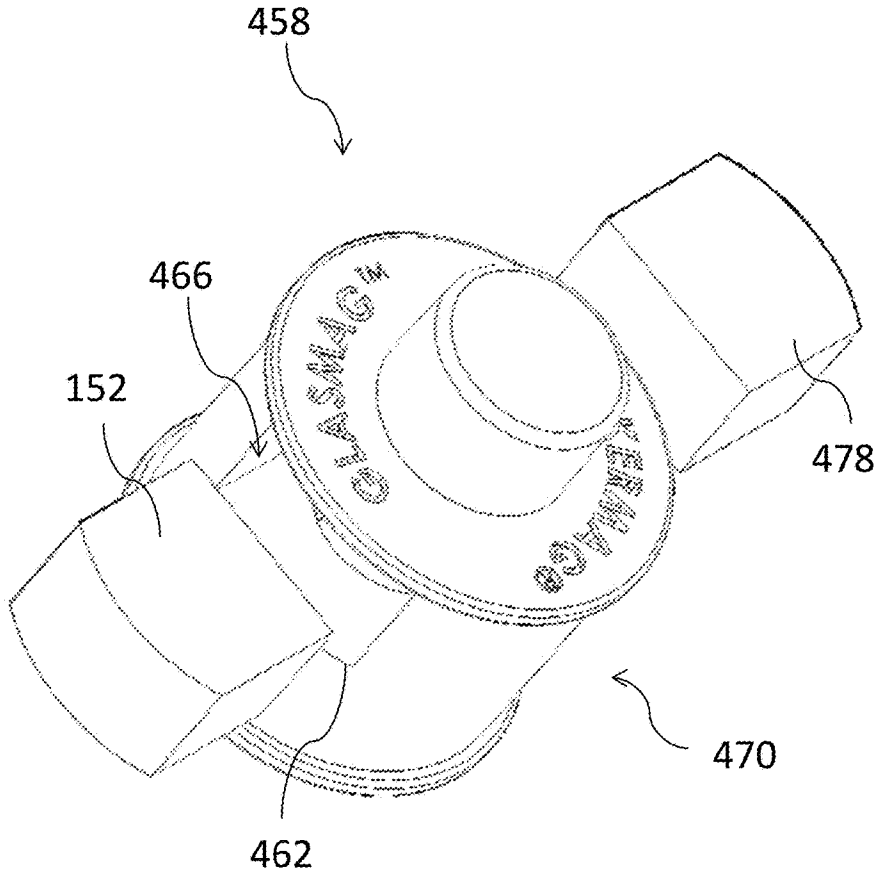

FIGS. 15-15(B) show another embodiment of an adaptor 458 that is similar to the adaptor 408. The adaptor 458 is configured as an insert for a non-ink end of a dry erase or other marker pen or can be integrated into a cap for such a pen, or formed as an integral part of a housing for the ink of a dry erase maker. The adaptor 458 is similar to the adaptor 408 except as described differently below.

The adaptor 458 includes a magnet compartment 462 formed in a magnet housing 470. The magnet housing 470 can be formed as a cylindrical body with a post at a first end and another end opposite the post. The magnet housing 470 can include a first opening 466 in one side thereof and a second opening 474 in another side thereof. In one embodiment, the second opening 474 is disposed away from the first opening 466. The first opening 466 and the second opening 474 can be disposed on opposite sides of the magnet housing 470, e.g., along a common diameter of the magnet housing 470. A magnet 152 can be disposed in the first opening 466. The magnet 152 can have an end surface thereof disposed at the first opening 466 such that the first pole 250 is on an exposed face of the magnet housing 470. A second magnet 478 can be disposed in the second opening 474. The second magnet 478 can have an end face disposed along the external surface of the magnet housing 470. The end face of the second magnet 478 can be curved. The end face of the second magnet 478 can have a first pole 480 of the second magnet 478. In one embodiment a continuous magnet compartment 462 can extend from the first opening 466 to the second opening 474. The magnet compartment 462 can house the magnet 152 and the second magnet 478. The magnet 152 and the second magnet 478 can abut one another in the magnet housing 470.

In one embodiment, the adaptor 458 is configured such that the first pole 250 and the first pole 480 are of the same polarity. This arrangement assures that if the adaptor 458 is placed adjacent to another adaptor 458 of the same configuration that the magnet 152 and the second magnet 478 in the two adaptors 458 will repel each other. This will cause the marker A and the marker B to rotate such that the magnets are not attracted to each other but are facing toward the whiteboard, glassboard, or the like such that the adaptor 458 and any marker or writing implement coupled therewith or into which the magnet 152 and the second magnet 478 are integrated in the arrangement shown will be self-supporting when so arranged. The same polarity arrangement could also just cause the pens A, B to move away from each other which could allow the pens A, B to independently automatically orient themselves to a self-supporting arrangement as discussed in connection with FIG. 12. The magnets 152 478 can be secured in the housing 470 in a manner that overcomes the magnetic repulsion of the poles opposite the poles 250, 480. For example, one of the magnets can be fixed in place either by an adhesive or surrounded by plastic, e.g., insert molded. The other magnet can be coupled in the housing 470 by an adhesive, or a clamp while the housing 470 is hardening or by other mechanical means. In another embodiment a material that attracts the poles opposite the poles 250, 480 can be placed between the two magnets 152, 478 with such attraction overcoming the magnetic repulsion of the poles opposite the poles 250, 480.

Figure 16A:
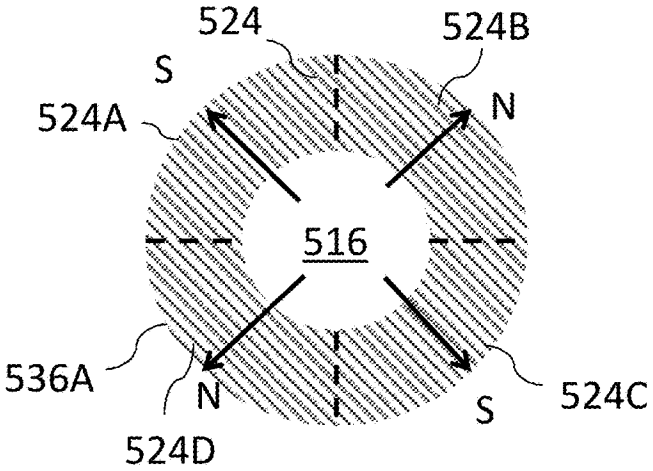
FIGS. 16-16(A) show a side and cross-sectional views of another embodiment of an adaptor for a writing implement.
Figure 16:
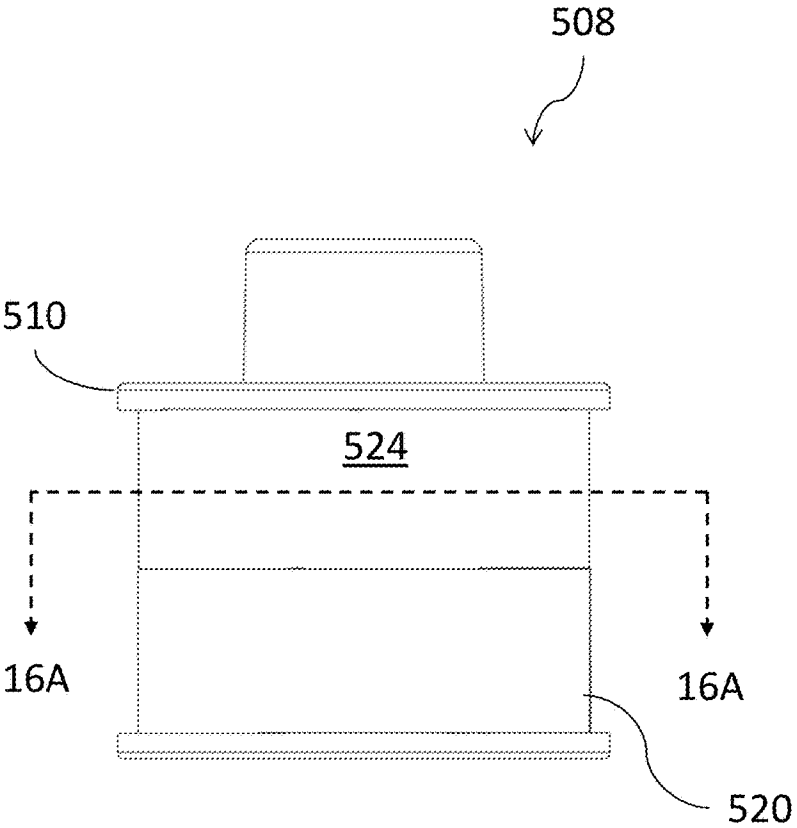
Figure 16B:
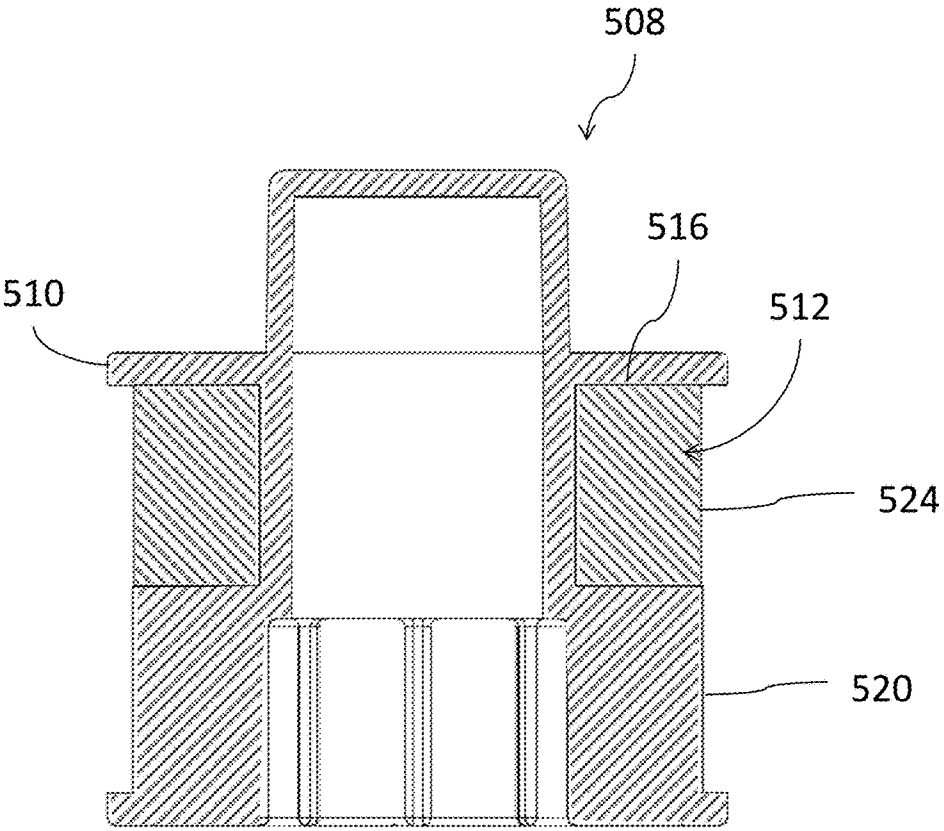
FIG. 16(B) is another cross-sectional view of the adaptor of FIG. 16 centered on the adaptor and taken at a section plane perpendicular to the section plane shown in FIG. 16.
Figure 16C:
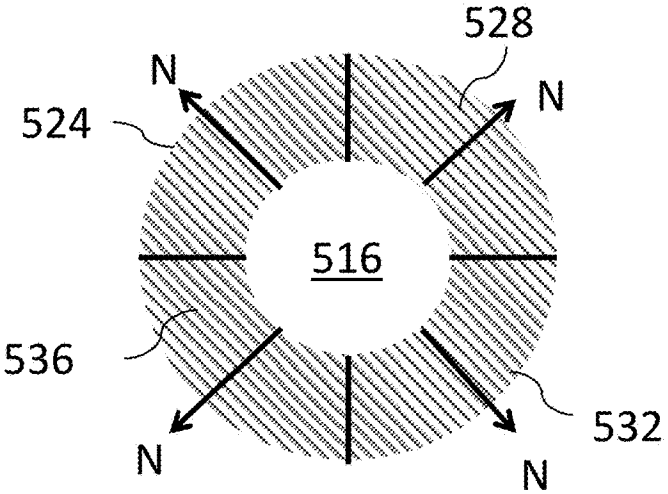
FIG. 16(C) cross-sectional view of a modified embodiment of that of FIG. 16.

FIGS. 16-16(C) illustrates further embodiments of an adaptor 508. The adaptor 508 can be similar to the other adaptors described herein. Any feature not inconsistent with the adaptor 508 can be combined with the features of the adaptor 508 discussed below. The adaptor 508 includes a magnet housing 510 that includes a magnet compartment 512. The magnet compartment 512 can be formed in a side surface of the magnet housing 510. The magnet compartment 512 can include an annular recess 516 that extend radially inwardly from a side surface 520 of the magnet housing 510. The adaptor 508 can include a recessed area to receive a sleeve similar to the sleeve 352. The recessed area can include the side surface 520 and an external surface of a magnet 524 disposed in the annular recess 516. The annular recess 516 can be recessed a second amount from the outermost perimeter of the magnet housing 510, a recessed surface configured to receive the sleeve can be recessed by a first amount that is less than the second amount. The second amount can correspond to the radial thickness of a magnet 524 that is received in the annular recess 516. The amount that the side surface 520 is recessed relative to the outer perimeter of the adaptor 508 can be related to the thickness of the sleeve if provided, e.g., can be about equal to the thickness of the sleeve to provide a smooth outer surface.

In one embodiment, the magnet 524 comprises an annular structure. FIG. 16(A) shows that the magnet 524 can be a continuous complete annulus. The magnet 524 includes a first region 524A, a second region 524B, a third region 524C, and a fourth region 524D. These four regions can each extend about one-quarter of the circumferential distance around the annular recess 516. Each of the regions can have an opposite polarity to a region adjacent thereto. The first region 524A can have a south polarity, the second region 524B can have a north polarity, the third region 524C can have a south polarity, the fourth region 524D can have a north polarity. The regions can have alternating polarity. These polarity arrangements provide that two adjacent markers A, B as described above will interact with each other to provide an orientation of the two that allows the makers A, B to be self-supporting. That is, if two makers A, B with the magnet arrangement (either as an adaptor or integrated in any other manner described herein with a marker or writing implement) are placed in close proximity to each other and to a whiteboard, glassboard, or the like as described herein, opposite polarity regions of the markers A, B will attract each other and at the same time present another strong magnetic field emanating from an adjacent magnet on each marker A, B to the board that provides a self-supporting arrangement for the markers A, B. The regions 524A-524D can be formed by any process of permanently magnetizing a region of a continuous structure such as an annulus.

FIG. 16(C) shows an alternative arrangement of the adaptor 508. The magnet 524 is an arcuate and can be one of a plurality of, e.g., of four, arcuate magnets that are assembled and placed in the annular recess 516. The magnet 524 can be placed adjacent to a second arcuate magnet 528. The second arcuate magnet 528 can be placed adjacent to a third arcuate magnet 532. A fourth arcuate magnet 536 can be placed between the third arcuate magnet 532 and the magnet 524. FIG. 16(C) shows that the arcuate magnets of the assembly can have the same externally facing polarity. That is, the radially outwardly facing surface of each of the magnets can have the same polarity. In some embodiments, exposed surfaces of the magnet 524 and the second arcuate magnet 528 can have opposite polarity. The exposed surfaces of the third arcuate magnet 532 and the fourth arcuate magnet 536 can have opposite polarity. Each of the magnet 524 and the second, third and fourth, arcuate magnet 528, 532, 536 can be configured as a north pole. Each of the magnet 524 and the second, third and fourth, arcuate magnet 528, 532, 536 can be configured as a south pole. When so configured two markers A, B coupled with or integrating the assembly of magnets will repel each other resulting in motion of one or both markers A, B in directions opposite of 390, 392 until the markers A, B are far enough apart that only the attraction thereof to the board 300 will provide a magnetic coupling to the markers A, B. Such attraction will be so as to self-support one or preferably both markers A, B.

Figure 17A:
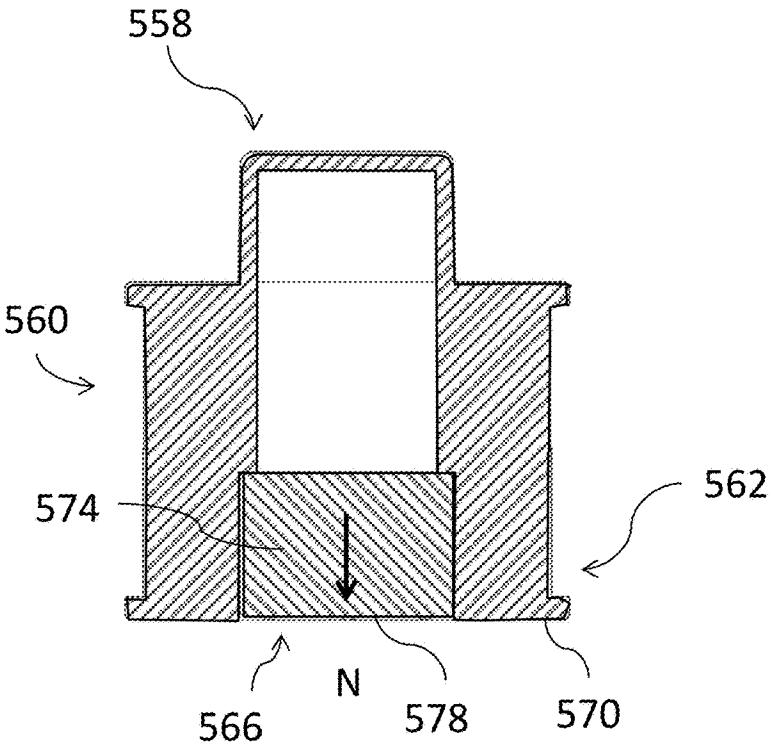
FIGS. 17-17(A) show a side and cross-sectional views of another embodiment of an adaptor for a writing implement.
Figure 17:
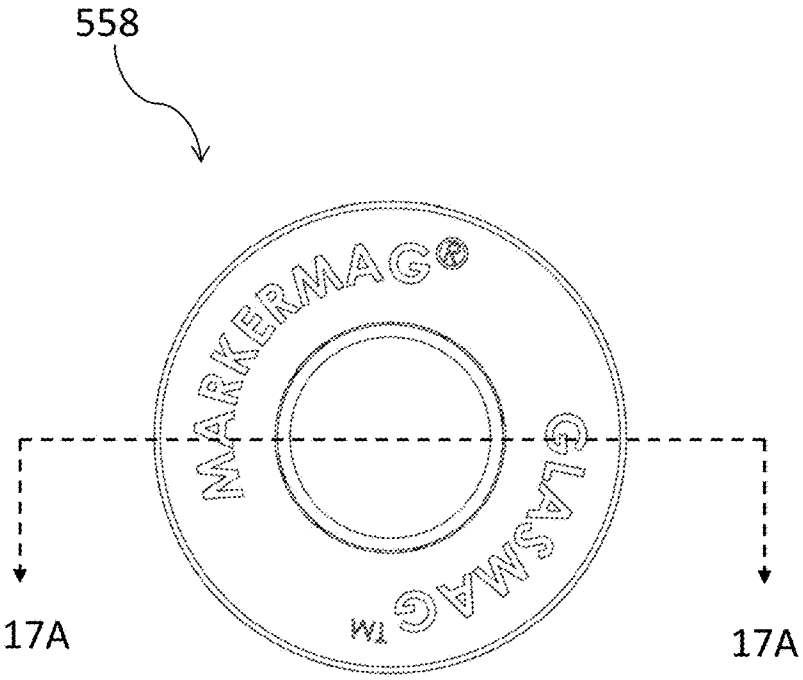

FIGS. 17-17(A) show an adaptor 558 that is similar to the adaptors discussed above and may include any consistent features thereof. As with other embodiments, the assembly of FIGS. 17-17(A) can be configured as an adaptor or can be integrated into a marker or writing implement in other ways, including as a cap, as a separate structure that includes a clip, an interference fit, integrated into a housing that also retains the marking member, etc. The adaptor 558 includes a magnet housing 560 that also includes a magnet compartment 562. The magnet compartment 562 can be disposed on an end of the magnet housing 560 opposite to a post that is configured to be received in a spoke type end of a marker. The magnet housing 560 and the magnet compartment 562 can be part of a housing of marker that also houses the ink, e.g., in a built-in non-removeable configuration. The magnet compartment 562 can include a recess 566 that extends from an end surface 570 of the magnet housing 560 into an interior space of the adaptor 558. The magnet compartment 562 can be configured to receive and retain therein a magnet 574. The magnet 574 can have an exposed surface 578 that comprises a pole. The magnetic field provided from the pole can be sufficient to self-support the adaptor 558, the adaptor 558 and a marker or writing implement coupled therewith and/or to support a marker or writing implement when used to couple the magnet 574 to the marker and thereby to couple the marker with a whiteboard, glassboard, or the like which is configured to magnetically engage the magnet 574. The adaptor 558 can be coupled to the marker or writing implement from a side or an end orientation. The magnet 574 can have a strength in a range of about 45 MGOe to about 60 MGOe.

The adaptors of FIGS. 14-17(A) can each be used to solve a problem that can arise when two or more markers A, B are being self-supported by magnetic fields generated from the markers. The magnet arrangements can cause the markers A, B to automatically arrange themselves related to the board 300 such that a sufficient magnetic field is provided to result in magnetic attraction to the board 300 and thus to a self-supporting arrangement. These improvements enable a collection of markers (e.g., of different colors) to be present at a single board 300 without the concern that the magnetic fields of the several pens will prevent the self-supporting arrangement discussed in connection with FIGS. 1-12.

Although certain embodiments are described herein as adaptors, a variety of integrated assemblies can also be provided within the scope of this application. That is, the structures of the adaptors can be integrated into a portion of a writing implement in certain applications.

As used herein, the relative terms "proximal" and "distal" shall be defined from the perspective of the tip of the writing implement. Thus, distal refers the direction of the tip of the writing implement, while proximal refers to the direction of the end of the writing implement opposite to the tip.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

The terms "approximately," "about," and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

Some embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Further, the actions of the disclosed processes and methods may be modified in any manner, including by reordering actions and/or inserting additional actions and/or deleting actions. Thus, it is intended that the scope of at least some of the present inventions herein disclosed should not be limited by the particular disclosed embodiments described above. The limitations in the claims are to be interpreted broadly based on the language employed in the claims and not limited to the examples described in the present specification or during the prosecution of the application, which examples are to be construed as non-exclusive.

What is claimed is:

1. An adaptor for securing a writing implement to a glassboard, a whiteboard, or the like, comprising:

a magnet housing having a magnet compartment disposed adjacent to a side periphery thereof;

a magnet disposed in the magnet compartment, the magnet providing a magnetic field away from the side periphery of the magnet housing; and a coupler for attaching an end of the magnet housing to an end of a writing implement;

wherein the adaptor comprises a magnet arrangement comprising more than two poles;

wherein when the coupler is attached to a writing implement, the magnetic field enables the adaptor to magnetically support the writing implement from a side position.

2. The adaptor of claim 1, wherein in use, the magnet will attach securely to a ferrous material through a non-ferrous material comprising a thickness equal or greater than ⅛" and up to ½".

3. The adaptor of claim 1, wherein the magnet has a BHmax between about 2 MGOe and about 60 MGOe and an externally measurable field between about 500 Gauss and about 10000 Gauss.

4. The adaptor of claim 1, further comprising a friction layer disposed on an outer surface thereof.

5. An assembly, comprising:

a writing implement, comprising:

an ink housing extending between a proximal and distal end of the writing implement;

an ink structure partly disposed in the ink housing and partly exposed at the distal end of the writing implement, the ink structure leaving visible marks upon contact with a writing surface; and the adaptor of claim 1, wherein a distal projection of the magnet housing is disposed within a proximal recess of the ink housing or a proximal recess of the magnet housing has a distal projection of the writing implement disposed therein.

6. A writing implement, comprising:

a housing having an elongate hollow structure having a side surface surrounding a cavity, a distal end, a proximal end, and a writing medium disposed within the cavity and exposed at the distal end; and the adaptor of claim 1 coupled with the housing and having a pole located along the side surface of the housing.

7. An adaptor for a writing implement, comprising:

a housing having a stepped side profile comprising a recessed portion extending from a first ledge that extends entirely around a circumference of the recessed portion and a magnet compartment disposed adjacent to a side periphery thereof in the recessed portion;

a magnet disposed in the magnet compartment; and a sleeve having first and second end portions and a cylindrical body, the first and second end portions being disposed in the recessed portion.

8. The writing implement of claim 7, wherein the magnet has a BHmax between about 2 MGOe and about 60 MGOe and an externally measurable field between about 500 Gauss and about 10000 Gauss.

9. The adaptor of claim 7, wherein a second ledge extends entirely around the circumference of the recessed portion.

10. The adaptor of claim 1, wherein the magnet is configured to automatically orient the adaptor to an orientation for self-supporting when positioned adjacent to an identical adaptor.

11. An adaptor for securing a writing implement to a glassboard, a whiteboard, or the like, comprising:

a magnet housing having a magnet compartment disposed adjacent to a side periphery thereof, the magnet compartment having a first opening at the side periphery and a second opening at the side periphery spaced from the first opening;

a first magnet disposed in the magnet compartment, a pole of the first magnet being disposed at the first opening, a magnetic field provided away from the pole of the first magnet at the side periphery;

a second magnet disposed in the magnet compartment, a pole of the second magnet being disposed at the second opening, a magnetic field provided away from the pole of the second magnet at the side periphery; and a coupler for attaching an end of the magnet housing to an end of a writing implement;

wherein when the coupler is attached to a writing implement, the magnetic field provided away from the pole of the first magnet and/or the magnetic field provided away from the pole of the second magnet enables the adaptor to magnetically support the writing implement from a side position; and wherein the magnet is configured to automatically orient the adaptor to an orientation for self-supporting when positioned adjacent to an identical adaptor.

12. The adaptor of claim 11, wherein the second opening is disposed circumferentially adjacent to the first opening, wherein the pole of the first magnet and the pole of the second magnet comprise opposite polarity.

13. The adaptor of claim 11, wherein the magnet housing further comprises a third opening opposite the first opening and a fourth opening disposed circumferentially between the first and the third openings, a third magnet positioned within the fourth opening, a pole of the third magnet having an opposite polarity to the pole of the second magnet.

14. The adaptor of claim 11, wherein the second opening is disposed circumferentially away from the first opening, the pole of the first magnet having the same polarity as the pole of the second magnet.

15. An adaptor for securing a writing implement to a glassboard, a whiteboard, or the like, comprising:

a magnet housing having a magnet compartment disposed adjacent to a side periphery thereof;

a magnet disposed in the magnet compartment, the magnet providing a magnetic field away from the side periphery of the magnet housing; and a coupler for attaching an end of the magnet housing to an end of a writing implement;

wherein when the coupler is attached to a writing implement, the magnetic field enables the adaptor to magnetically support the writing implement from a side position;

wherein the magnet is configured to automatically orient the adaptor to an orientation for self-supporting when positioned adjacent to an identical adaptor; and wherein the magnet compartment comprises an annular recess formed in a side surface of the magnet housing, the magnet comprising an arcuate body disposed within the recess.

16. The adaptor of claim 15, wherein the annular recess extends entirely around the magnet housing and the magnet comprises an annulus configured to be disposed in the recess.

17. The adaptor of claim 15, wherein the magnet comprises a first region, a second region adjacent to the first region, a third region adjacent to the second region, and a fourth region between the first region and the third region, the first and second regions having opposite polarity, the second and third regions having opposite polarity, and the third and fourth regions having opposite polarity.

18. The adaptor of claim 15, wherein the annular recess extends entirely around the magnet housing and the magnet comprises a first arcuate magnet, the adaptor further comprising a second arcuate magnet disposed circumferentially adjacent to the first arcuate magnet.

19. The adaptor of claim 18, further comprising a third arcuate magnet disposed adjacent to the second arcuate magnet and a fourth arcuate magnet disposed between the first arcuate magnet and the third arcuate magnet, the first arcuate magnet having an exposed surface, the second arcuate magnet having an exposed surface, the third arcuate magnet having an exposed surface, and the fourth arcuate magnet having an exposed surface, the exposed surfaces all having the same polarity.

20. The adaptor of claim 18, further comprising a third arcuate magnet disposed adjacent to the second arcuate magnet and a fourth arcuate magnet disposed between the first arcuate magnet and the third arcuate magnet, the first arcuate magnet and the second arcuate magnet having exposed surfaces with opposite polarity, the third arcuate magnet and the fourth arcuate magnet having exposed surfaces with opposite polarity.

21. The adaptor of claim 10, wherein the magnet compartment includes a recess formed in an end surface of the magnet housing, the magnet having an exposed surface providing a magnetic field away from the end surface for the adaptor sufficient to support a marker with which the adaptor is coupled from a side or an end orientation.

* * * * *